US009404312B2

(12) United States Patent
Azar et al.

(10) Patent No.: US 9,404,312 B2
(45) Date of Patent: Aug. 2, 2016

(54) CUTTING STRUCTURES FOR FIXED CUTTER DRILL BIT AND OTHER DOWNHOLE CUTTING TOOLS

(75) Inventors: Michael G. Azar, The Woodlands, TX (US); Bala Durairajan, Houston, TX (US); Madapusi K. Keshavan, The Woodlands, TX (US)

(73) Assignee: SMITH INTERNATIONAL, INC, Houston, TX (US)

( * ) Notice: Subject to any disclaimer, the term of this patent is extended or adjusted under 35 U.S.C. 154(b) by 1130 days.

(21) Appl. No.: 13/370,862

(22) Filed: Feb. 10, 2012

(65) Prior Publication Data

US 2012/0234610 A1 Sep. 20, 2012

Related U.S. Application Data

(60) Provisional application No. 61/441,319, filed on Feb. 10, 2011, provisional application No. 61/499,851, filed on Jun. 22, 2011.

(51) Int. Cl.

| | |
|---|---|
| ***E21B 10/26*** | (2006.01) |
| ***E21B 10/62*** | (2006.01) |
| ***E21B 10/43*** | (2006.01) |
| ***E21B 10/46*** | (2006.01) |
| ***E21B 10/54*** | (2006.01) |

(Continued)

(52) U.S. Cl.

CPC ..... *E21B 10/62* (2013.01); *E21B 10/26* (2013.01); *E21B 10/42* (2013.01); *E21B 10/43* (2013.01); *E21B 10/46* (2013.01); *E21B 10/54* (2013.01); *E21B 10/55* (2013.01); *E21B 10/56* (2013.01); *E21B 10/567* (2013.01); *E21B 10/5673* (2013.01); *E21B 10/627* (2013.01); *E21B 10/633* (2013.01); *E21B 2010/425* (2013.01); *E21B 2010/545* (2013.01); *E21B 2010/561* (2013.01); *E21B 2010/562* (2013.01); *E21B 2010/622* (2013.01); *E21B 2010/624* (2013.01)

(58) Field of Classification Search

CPC ..... E21B 10/26; E21B 10/567; E21B 10/42; E21B 10/62

See application file for complete search history.

(56) References Cited

U.S. PATENT DOCUMENTS

| | | | |
|---|---|---|---|
| 2,941,241 | A | 6/1960 | Strong |
| 2,941,248 | A | 6/1960 | Hall |

(Continued)

FOREIGN PATENT DOCUMENTS

| | | | |
|---|---|---|---|
| BE | 1014561 | A3 | 12/2003 |
| CN | 2227191 | Y | 5/1996 |

(Continued)

OTHER PUBLICATIONS

Notice of Allowance issued in related U.S. Appl. No. 13/826,193; Dated Jul. 7, 2014 (9 pages).

(Continued)

*Primary Examiner* — William P Neuder

(57) ABSTRACT

A downhole cutting tool may include a tool body; a plurality of blades extending azimuthally from the tool body; and a plurality of cutting elements disposed on the plurality of blades, the plurality of cutting elements comprising: at least two conical cutting elements comprising a substrate and a diamond layer having a conical cutting end, wherein at least one of the at least two conical cutting elements has a positive back rake angle, and at least one of the at least two conical cutting elements has a negative back rake angle.

30 Claims, 29 Drawing Sheets

(51) Int. Cl.

| | |
|---|---|
| ***E21B 10/55*** | (2006.01) |
| ***E21B 10/567*** | (2006.01) |
| *E21B 10/42* | (2006.01) |
| *E21B 10/56* | (2006.01) |
| *E21B 10/627* | (2006.01) |
| *E21B 10/633* | (2006.01) |

(56) References Cited

U.S. PATENT DOCUMENTS

| | | | | |
|---|---|---|---|---|
| 2,947,611 | A | | 8/1960 | Bundy |
| 3,609,818 | A | | 10/1971 | Wentorf |
| 3,767,371 | A | | 10/1973 | Wentorf et al. |
| 4,104,344 | A | | 8/1978 | Pope et al. |
| 4,224,380 | A | | 9/1980 | Bovenkerk et al. |
| 4,288,248 | A | | 9/1981 | Bovenkerk et al. |
| 4,289,503 | A | | 9/1981 | Corrigan |
| 4,525,178 | A | | 6/1985 | Hall |
| 4,553,615 | A | | 11/1985 | Grainger |
| 4,640,374 | A | † | 2/1987 | Dennis |
| 4,673,414 | A | | 6/1987 | Lavens et al. |
| 4,694,918 | A | | 9/1987 | Hall |
| 4,882,128 | A | | 11/1989 | Hukvari et al. |
| 4,933,529 | A | | 6/1990 | Saville |
| 4,954,139 | A | | 9/1990 | Cerutti |
| 5,369,034 | A | | 11/1994 | Hargett et al. |
| 5,370,195 | A | | 12/1994 | Keshavan et al. |
| 5,582,261 | A | | 12/1996 | Keith et al. |
| 5,655,614 | A | | 8/1997 | Azar |
| 5,695,019 | A | † | 12/1997 | Shamburger |
| 6,283,233 | B1 | | 9/2001 | Lamine et al. |
| 6,332,503 | B1 | | 12/2001 | Pessier et al. |
| 6,394,202 | B2 | | 5/2002 | Truax et al. |
| 6,440,224 | B1 | | 8/2002 | Wei et al. |
| 6,744,024 | B1 | | 6/2004 | Hayes et al. |
| 7,703,559 | B2 | | 4/2010 | Shen et al. |
| 7,748,475 | B2 | | 7/2010 | McClain et al. |
| 7,757,789 | B2 | | 7/2010 | Yong et al. |
| 7,845,438 | B1 | | 12/2010 | Vail et al. |
| 7,866,419 | B2 | | 1/2011 | Lockwood |
| 7,992,658 | B2 | | 8/2011 | Buske |
| 8,517,125 | B2 | | 8/2013 | Lockwood |
| 8,881,849 | B2 | | 11/2014 | Shen et al. |
| 8,887,837 | B2 | * | 11/2014 | Azar et al. ..... 175/426 |
| 8,991,523 | B2 | | 3/2015 | Shen et al. |
| 2004/0094334 | A1 | | 5/2004 | Singh |
| 2006/0011388 | A1 | | 1/2006 | Boudrare et al. |
| 2006/0081402 | A1 | | 4/2006 | Lockwood et al. |
| 2007/0114071 | A1 | | 5/2007 | Hall |
| 2007/0221406 | A1 | | 9/2007 | Hall et al. |
| 2008/0017421 | A1 | | 1/2008 | Lockwood |
| 2008/0029312 | A1 | | 2/2008 | Hall et al. |
| 2008/0035380 | A1 | | 2/2008 | Hall et al. |
| 2008/0035387 | A1 | | 2/2008 | Hall et al. |
| 2008/0099251 | A1 | | 5/2008 | Hall et al. |
| 2008/0173482 | A1 | | 7/2008 | Hall et al. |
| 2008/0185189 | A1 | | 8/2008 | Griffo et al. |
| 2008/0223623 | A1 | | 9/2008 | Keshavan et al. |
| 2008/0282618 | A1 | | 11/2008 | Lockwood |
| 2008/0314647 | A1 | | 12/2008 | Hall et al. |
| 2009/0120008 | A1 | | 5/2009 | Lockwood et al. |
| 2009/0139150 | A1 | | 6/2009 | Ras |
| 2009/0145663 | A1 | | 6/2009 | Durairajan et al. |
| 2009/0145669 | A1 | | 6/2009 | Durairajan et al. |
| 2009/0152018 | A1 | | 6/2009 | Sani |
| 2010/0018780 | A1 | | 1/2010 | Johnson et al. |
| 2010/0059288 | A1 | | 3/2010 | Hall et al. |
| 2010/0065332 | A1 | | 3/2010 | Hall et al. |
| 2010/0065338 | A1 | | 3/2010 | Hall et al. |
| 2010/0065339 | A1 | | 3/2010 | Hall et al. |
| 2010/0071964 | A1 | | 3/2010 | Hall et al. |
| 2010/0089648 | A1 | | 4/2010 | Hall et al. |
| 2010/0101870 | A1 | † | 4/2010 | Shamburger |
| 2010/0122013 | A1 | | 5/2010 | Klaiber et al. |
| 2010/0133013 | A1 | † | 6/2010 | Hahati |
| 2010/0218999 | A1 | | 9/2010 | Jones et al. |
| 2010/0219001 | A1 | | 9/2010 | Shen et al. |
| 2010/0276145 | A1 | | 11/2010 | Dewey et al. |
| 2010/0300673 | A1 | | 12/2010 | Richert et al. |
| 2010/0314176 | A1 | * | 12/2010 | Zhang et al. ..... 175/383 |
| 2011/0048811 | A1 | | 3/2011 | Hall et al. |
| 2011/0192651 | A1 | * | 8/2011 | Lyons ..... E21B 10/5673 175/428 |
| 2011/0192653 | A1 | | 8/2011 | Stowe, II |
| 2011/0259650 | A1 | | 10/2011 | Hall et al. |
| 2011/0297454 | A1 | | 12/2011 | Shen et al. |
| 2012/0031674 | A1 | * | 2/2012 | Lyons ..... 175/57 |
| 2012/0205163 | A1 | | 8/2012 | Azar et al. |
| 2012/0273280 | A1 | | 11/2012 | Zhang et al. |
| 2012/0273281 | A1 | | 11/2012 | Burhan et al. |
| 2013/0020134 | A1 | | 1/2013 | Azar et al. |

FOREIGN PATENT DOCUMENTS

| | | | |
|---|---|---|---|
| CN | 101310090 | A | 11/2008 |
| CN | 201269049 | Y | 7/2009 |
| CN | 101611211 | A | 12/2009 |
| EP | 0874128 | A2 | 10/1998 |
| GB | 2446512 | A | 8/2008 |
| JP | S59123772 | A | 7/1984 |
| JP | H111264088 | A | 9/1999 |
| RU | 2087666 | C1 | 8/1997 |
| RU | 2008115275 | A | 10/2009 |
| RU | 2009125622 | A | 1/2011 |
| SU | 1495427 | A1 | 7/1989 |
| WO | 2010011500 | A1 | 1/2010 |

OTHER PUBLICATIONS

International Search Report and Written Opinon issued in corresponding International Application No. PCT/US2012/024606 dated May 17, 2012 (8 pages).

International Search Report and Written Opinion issued in corresponding International Application No. PCT/US2012/024609 dated May 17, 2012 (7 pages).

International Search Report and Written Opinion issued in corresponding International Application No. PCT/US2012/024606 dated May 17, 2012 (8 pages).

Examiner's Report issued in Canadian Application No. 2826939; Dated Aug. 21, 2014 (3 pages).

Office Action issued in related U.S. Appl. No. 12/826,193; Dated Nov. 25, 2013 (21 pages).

Office Action issued in corresponding Chinese Application No. 201280008571.9, mailed Mar. 23, 2015 (16 pages).

Notice of Allowance issued in related U.S. Appl. No. 13/826,193; Dated Apr. 1, 2014 (11 pages).

Examiner's Report issued in corresponding Canadian Application No. 2,827,116; Dated Oct. 16, 2014 (3 pages).

Non-Final Office Action issued in related U.S. Appl. No. 13/370,734, mailed May 6, 2015 (12 pages).

Office Action issued in Chinese Application No. 201280040733.7; Dated May 6, 2015 (25 pages).

Office Action issued in Chinese Application No. 201280008587.X; Dated May 6, 2015 (17 pages).

* cited by examiner
† cited by third party

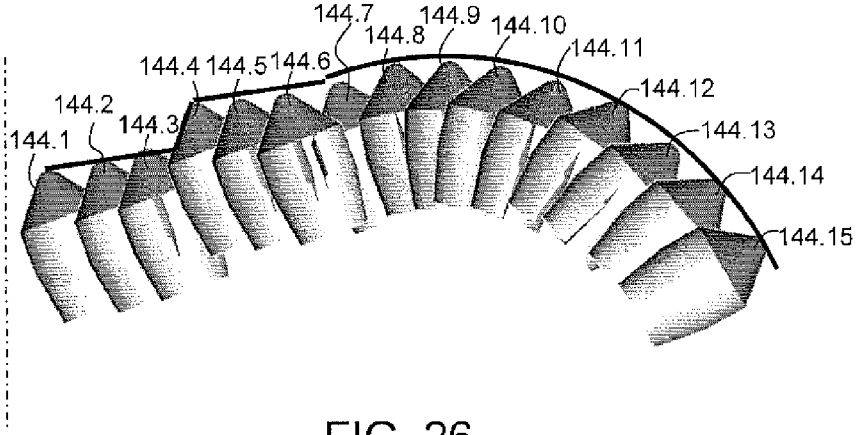
FIG. 26
FIG. 27
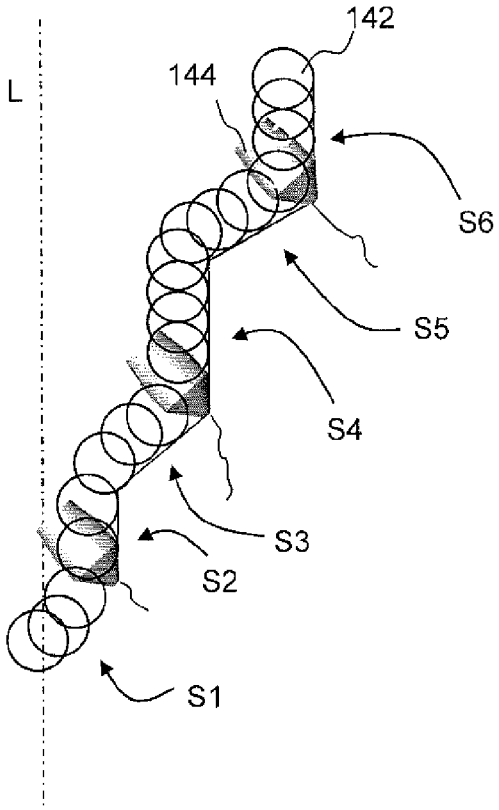

CUTTING STRUCTURES FOR FIXED CUTTER DRILL BIT AND OTHER DOWNHOLE CUTTING TOOLS

CROSS-REFERENCE TO RELATED APPLICATIONS

This application claims priority to U.S. Application No. 61/441,319, filed on Feb. 10, 2011, and U.S. Patent Application No. 61/499,851, filed on Jun. 22, 2011, both of which are herein incorporated by reference in their entirety.

BACKGROUND

1. Field

Embodiments disclosed herein generally relate to fixed cutter cutting tools containing cutting structures containing two or more types of cutting elements, each type having a different mode of cutting action against a formation. Other embodiments disclosed herein relate to fixed cutter cutting tools containing conical cutting elements, including the placement of such cutting elements on a bit and variations on the cutting elements that may be used to optimize drilling.

2. Background Art

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocked formed in the surface of one of the blades. The cutting elements typically includes a hard cutting layer of polycrystalline diamond (PCD) or other superabrasive materials such as thermally stable diamond or polycrystalline cubic boron nitride. For convenience, as used herein, reference to "PDC bit" "PDC cutters" refers to a fixed cutter bit or cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. Bit 10 generally includes a bit body 12, a shank 13, and a threaded connection or pin 14 for connecting the bit 10 to a drill string (not shown) that is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a position that is distal bit axis 11 toward the periphery of bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip 44*a* furthest from blade tops 42, 52 to which cutting element 40 is mounted.

Referring now to FIG. 3, a profile of bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of bit 10 form and define a combined or composite blade profile 39 that extends radially from bit axis 11 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

Conventional composite blade profile 39 (most clearly shown in the right half of bit 10 in FIG. 3) may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the bit 10.

Without regard to the type of bit, the cost of drilling a borehole is proportional to the length of time it takes to drill the borehole to the desired depth and location. The drilling time, in turn, is greatly affected by the number of times the drill bit must be changed in order to reach the targeted formation. This is the case because each time the bit is changed, the entire drill string, which may be miles long, must be retrieved from the borehole section by section. Once the drill string has been retrieved and the new bit installed, the bit must be lowered to the bottom of the borehole on the drill string, which again must be constructed section by section. This process, known as a "trip" of the drill string, requires considerable time, effort, and expense. Accordingly, it is always desirable to employ drill bits that will drill faster and longer and that are usable over a wider range of differing formation hardnesses.

The length of time that a drill bit may be employed before it must be changed depends upon its rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes premature wearing or destruction of the cutting elements and a loss of penetration rate. Thus, preventing bit vibration and maintaining stability of PDC bits has long been a desirable goal, but one which has not always been achieved. Bit vibration typically may occur in any type of formation, but is most detrimental in the harder formations.

In recent years, the PDC bit has become an industry standard for cutting formations of soft and medium hardnesses. However, as PDC bits are being developed for use in harder formations, bit stability is becoming an increasing challenge. As previously described, excessive bit vibration during drilling tends to dull the bit and/or may damage the bit to an extent that a premature trip of the drill string becomes necessary.

There have been a number of alternative designs proposed for PDC cutting structures that were meant to provide a PDC bit capable of drilling through a variety of formation hardnesses at effective ROPs and with acceptable bit life or durability. Unfortunately, may of the bit designs aimed at minimizing vibration require that drilling be conducted with an increased weight-on-bit (WOB) as compared to bits of earlier designs. For example, some bits have been designed with cutters mounted at less aggressive back rake angles such that they require increased WOB in order to penetrate the formation material to the desired extent. Drilling with an increased or heavy WOB has serious consequences and is generally avoided if possible. Increasing the WOB is accomplished by adding additional heavy drill collars to the drill string. This additional weight increases the stress and strain on all drill string components, causes stabilizers to wear more and to work less efficiently and increases the hydraulic drop in the drill string, requiring the use of higher capacity (and typically higher cost) pumps for circulating the drilling fluid. Compounding the problem still further, the increased WOB causes the bit to wear and become dull much more quickly than would otherwise occur. In order to postpone tripping the drill string, it is common practice to add further WOB and to continue drilling with the partially worn and dull bit. The relationship between bit wear and WIB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

Accordingly, there remains a continuing need for fixed cutter drill bits capable of drilling effectively at economical ROPs and ideally to drill in formations having a hardness greater than in which conventional PDC bits can be employed. More specifically, there is a continuing need for a PDC bit that can drill in soft, medium, medium hard, and even in some hard formations while maintaining an aggressive cutting element profile so as to maintain acceptable ROPs for acceptable lengths of time and thereby lower the drilling costs presently experienced in the industry.

SUMMARY OF INVENTION

In one aspect, embodiments disclosed herein relate to a downhole cutting tool that includes a tool body; a plurality of blades extending azimuthally from the tool body; and a plurality of cutting elements disposed on the plurality of blades, the plurality of cutting elements comprising: at least two conical cutting elements comprising a substrate and a diamond layer having a conical cutting end, wherein at least one of the at least two conical cutting elements has a positive back rake angle, and at least one of the at least two conical cutting elements has a negative back rake angle.

In another aspect, embodiments disclosed herein relate to a downhole cutting tool that includes: a tool body; a plurality of blades extending azimuthally from the tool body; and a plurality of cutting elements disposed on the plurality of blades, the plurality of cutting elements comprising: at least two conical cutting elements comprising a substrate and a diamond layer having a conical cutting end, wherein at least one of the at least two conical cutting elements has a positive side rake angle, and at least one of the at least conical cutting elements has a negative side rake angle.

In yet another aspect, embodiments disclosed herein relate to a downhole cutting tool that includes: a tool body; a plurality of blades extending azimuthally from the tool body; and a plurality of cutting elements disposed on the plurality of blades, the plurality of cutting elements comprising: at least one cutter having a substrate and a diamond table with a substantially planar cutting face; at least one conical cutting elements comprising a substrate and a diamond layer having a conical cutting end, wherein the at least one cutter and the at least one conical cutting element are disposed at the same radial distance from a bit centerline.

In yet another aspect, embodiments disclosed herein relate to a drill bit for drilling a borehole in earth formations that includes: a bit body having a bit axis and a bit face; a plurality of blades extending radially along the bit face; a plurality of cutting elements disposed on the plurality of blades, and a conical coring cutting element disposed in a region between at least two blades, wherein an apex of the conical coring cutting element is at a height H less than a cutting edge of the most radially interior cutting element, wherein H ranges up to 0.35 times a diameter of the bit.

In yet another aspect, embodiments disclosed herein relate to a downhole cutting tool that includes: a tool body; a plurality of blades extending azimuthally from the tool body; and a plurality of cutting elements disposed on the plurality of blades, the plurality of cutting elements comprising: at least one conical cutting elements comprising a substrate and a diamond layer having a conical cutting end, wherein a cutting profile of the plurality of cutting elements in a rotated view comprises at least one non-smooth step therein.

Other aspects and advantages of the invention will be apparent from the following description and the appended claims.

BRIEF DESCRIPTION OF DRAWINGS

FIG. 26 shows a cutting profile according to one embodiment of the present disclosure.

FIG. 27 shows a cutting profile according to one embodiment of the present disclosure.

DETAILED DESCRIPTION

In one aspect, embodiments disclosed herein relate to fixed cutting drill bits or other downhole cutting tools containing multiple types of cutting structures. In particular, embodiments disclosed herein relate to drill bits containing two or more types of cutting elements, each type having a different mode of cutting action against a formation. Other embodiments disclosed herein relate to fixed cutter drill bits containing conical cutting elements, including the placement of such cutting elements on a bit and variations on the cutting elements that may be used to optimize drilling.

Figure 1:
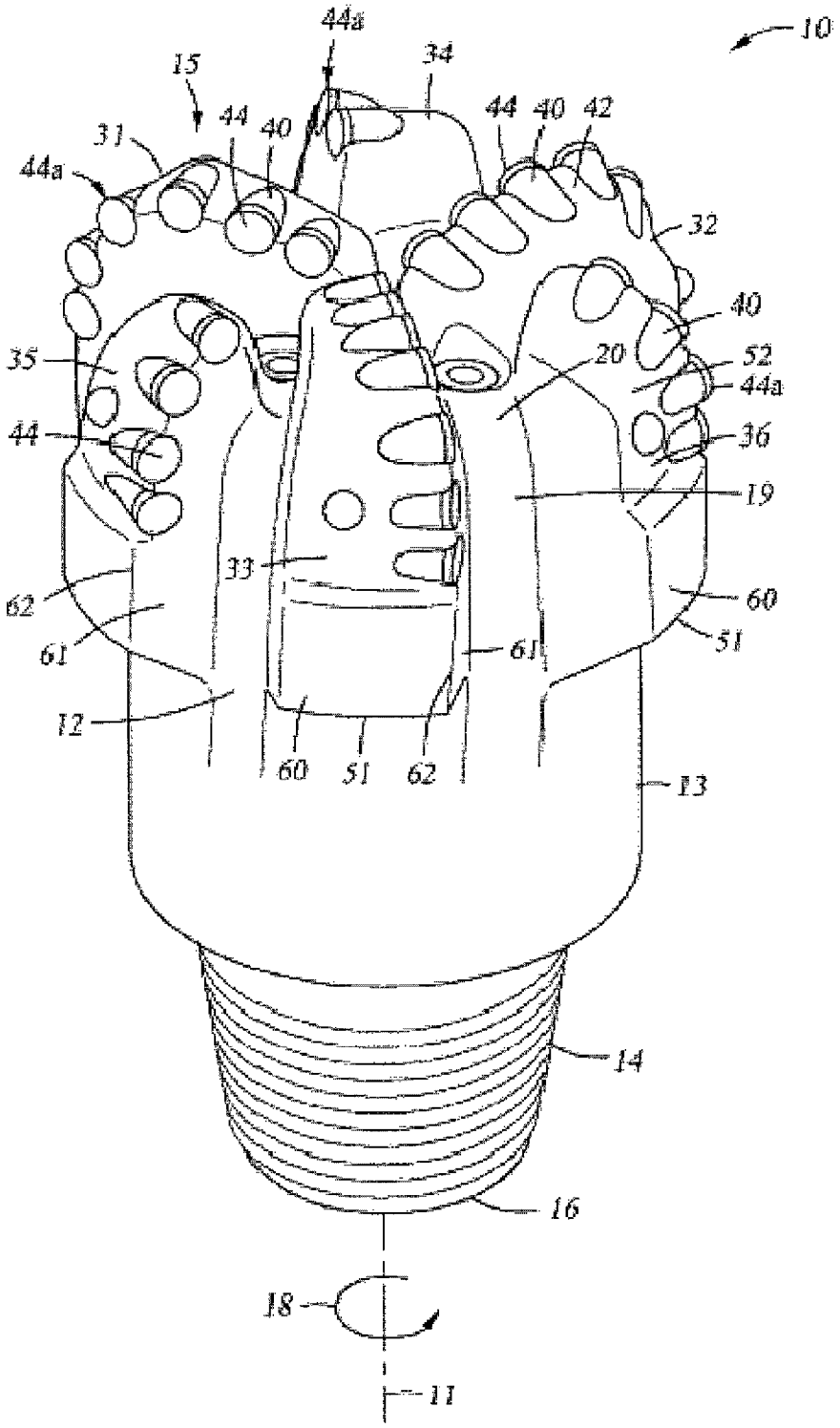
Fig. 1 (PRIOR ART)
FIG. 1 shows a prior art drill bit.
Figure 2:
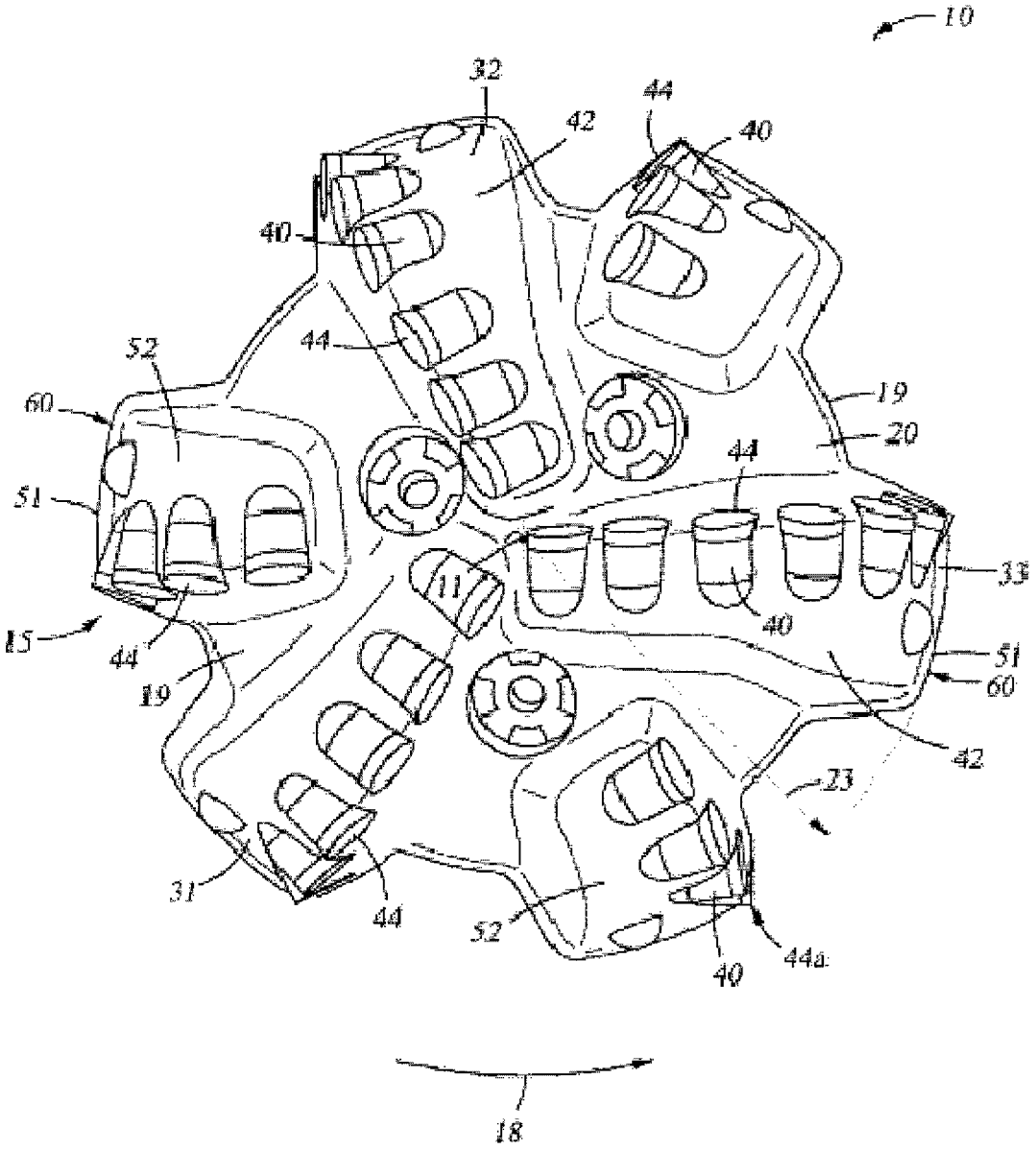
Fig. 2 (PRIOR ART)
FIG. 2 shows a top view of a prior art drill bit.
Figure 3:
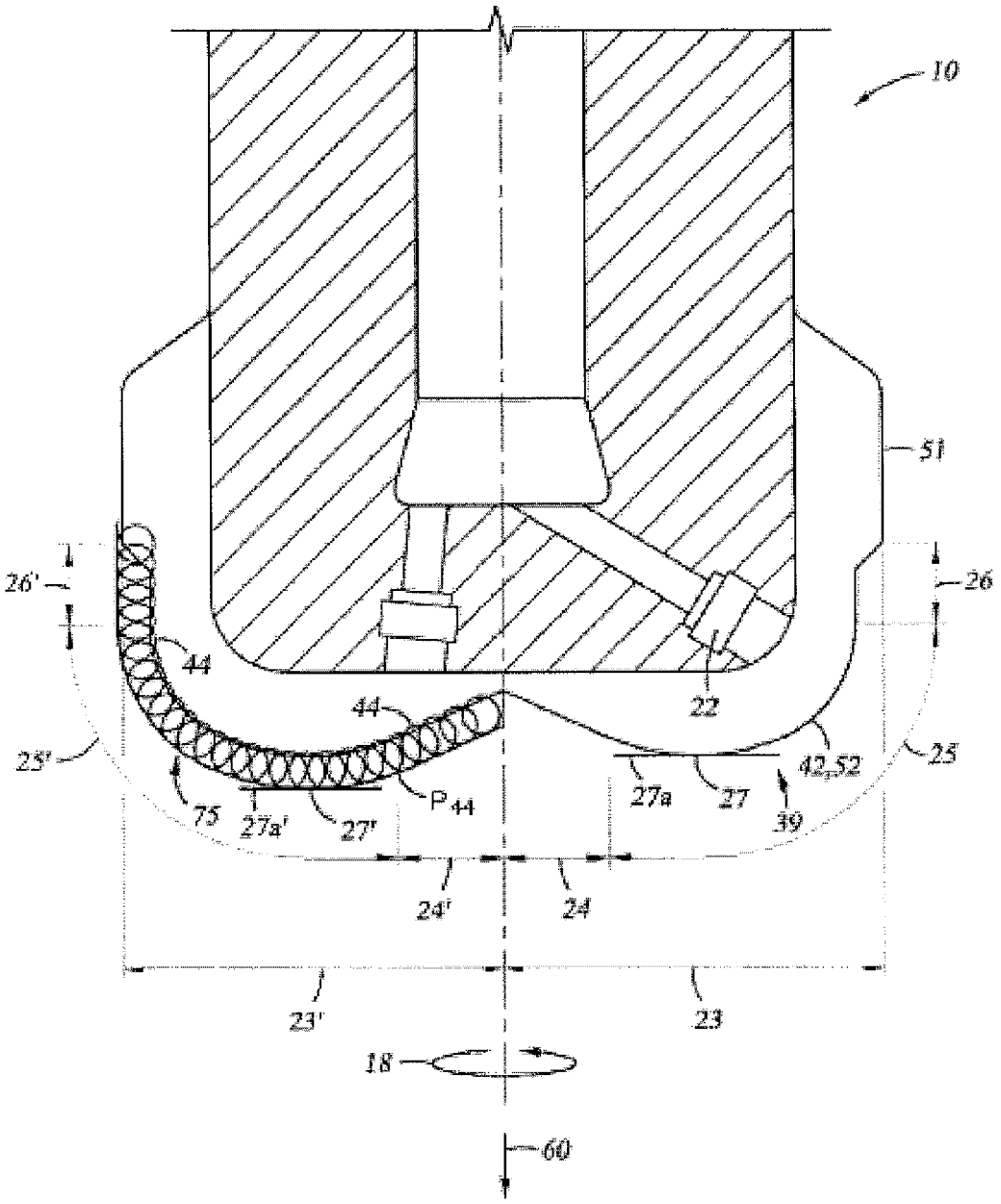
Fig. 3 (PRIOR ART)
FIG. 3 shows a cross-sectional view of a prior art drill bit.
Figure 4:
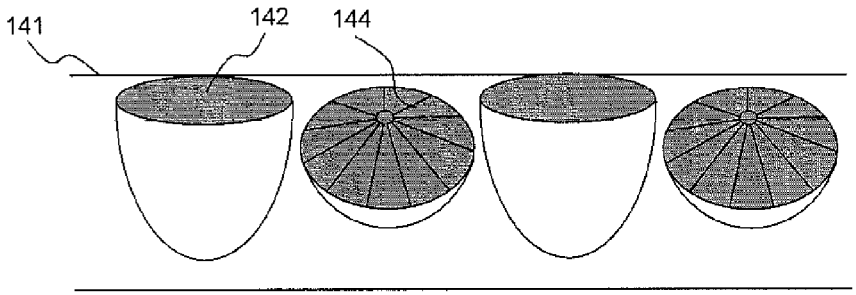
FIG. 4 shows cutting elements according to one embodiment of the present disclosure.
Figure 5:
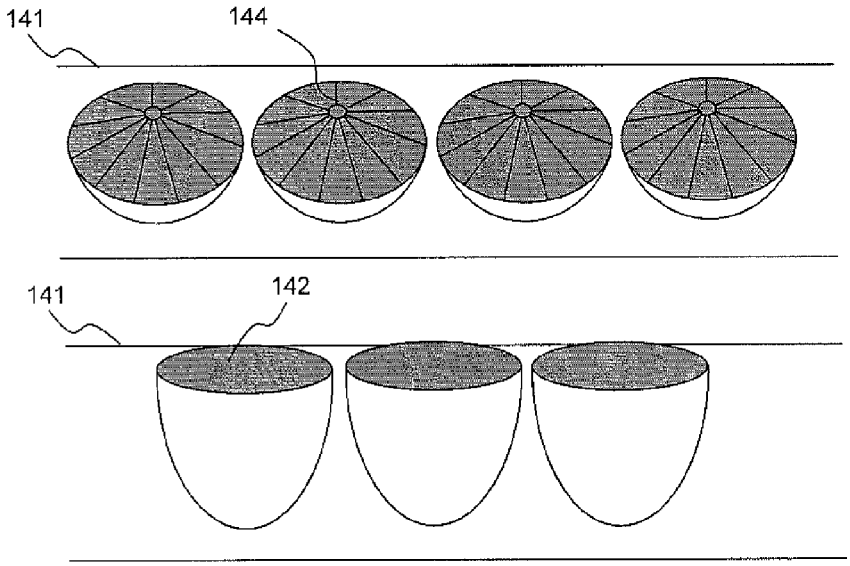
FIG. 5 shows cutting elements according to one embodiment of the present disclosure.

Referring to FIGS. 4 and 5, representative blades having cutting elements thereon for a drill bit (or reamer) formed in accordance with one embodiment of the present disclosure are shown. As shown in FIG. 4, the blade 140 includes a plurality of cutters 142 conventionally referred to as cutters or PDC cutters as well as a plurality of conical cutting elements 144. As used herein, the term "conical cutting elements" refers to cutting elements having a generally conical cutting end (including either right cones or oblique cones) that terminate in a rounded apex. Unlike geometric cones that terminate at an a sharp point apex, the conical cutting elements of the present disclosure possess an apex having curvature between the side surfaces and the apex. The conical cutting elements 144 stand in contrast to the cutters 142 that possess a planar cutting face. For ease in distinguishing between the two types of cutting elements, the term "cutting elements" will generically refer to any type of cutting element, while "cutter" will refer those cutting elements with a planar cutting face, as described above in reference to FIGS. 1 and 2, and "conical cutting element" will refer to those cutting elements having a generally conical cutting end. The embodiment shown in FIG. 4 includes cutters 142 and conical cutting elements 144 on a single blade, whereas the embodiment shown in FIG. 5 includes cutters on one blade, and conical cutting elements 144 on a second blade. Specifically, in the embodiment shown in FIG. 5, the cutters 142 are located on a blade 141 that trails the blade on which conical cutting elements 144 are located; however, the present disclosure is not necessarily so limited.

Figure 6:
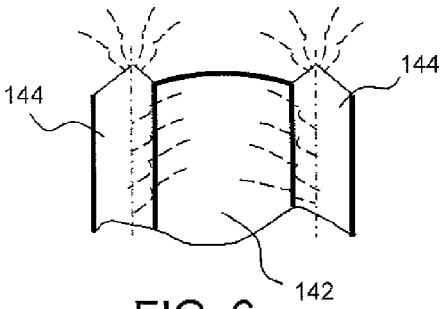
FIG. 6 shows cutting elements according to one embodiment of the present disclosure.
Figure 7:
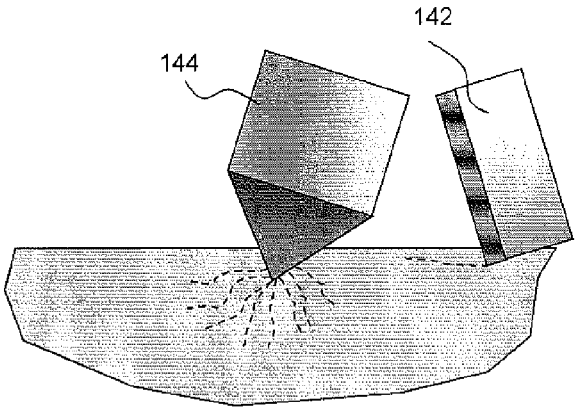
FIG. 7 shows cutting elements according to one embodiment of the present disclosure.

Referring to FIGS. 6-7, The present inventors have found that the use of conventional, planar cutters 142 in combination with conical cutting elements 144 may allow for a single bit to possess two types of cutting action (represented by dashed lines): cutting by compressive fracture or gouging of the formation by conical cutting elements 142 in addition to cutting by shearing the formation by cutters 142, as shown in the schematics in FIGS. 6 and 7.

Figure 8:
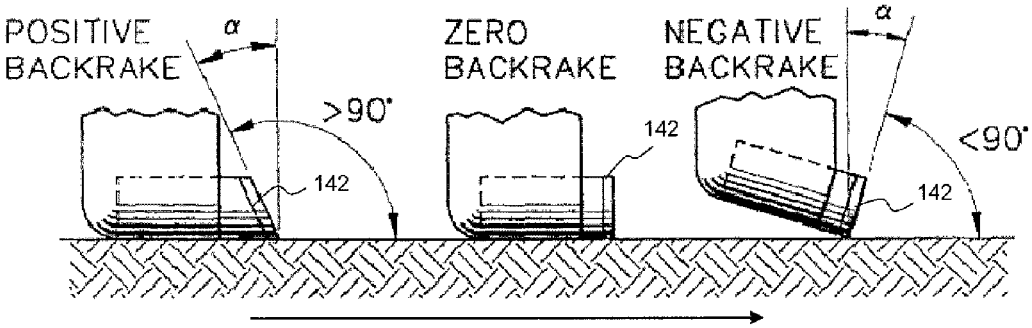
FIG. 8 shows rotation of cutting elements according to one embodiment of the present disclosure.

Generally, when positioning cutting elements (specifically cutters) on a blade of a bit or reamer, the cutters may be inserted into cutter pockets (or holes in the case of conical cutting elements) to change the angle at which the cutter strikes the formation. Specifically, the back rake (i.e., a vertical orientation) and the side rake (i.e., a lateral orientation) of a cutter may be adjusted. Generally, back rake is defined as the angle $\alpha$ formed between the cutting face of the cutter 142 and a line that is normal to the formation material being cut. As shown in FIG. 8, with a conventional cutter 142 having zero back rake, the cutting face 44 is substantially perpendicular or normal to the formation material. A cutter 142 having negative back rake angle $\alpha$ has a cutting face 44 that engages the formation material at an angle that is less than 90° as measured from the formation material. Similarly, a cutter 142 having a positive back rake angle $\alpha$ has a cutting face 44 that engages the formation material at an angle that is greater than 90° when measured from the formation material. According to various embodiments of the present disclosure, the back rake of the conventional cutters 142 may range from −5 to −45

Figure 9:
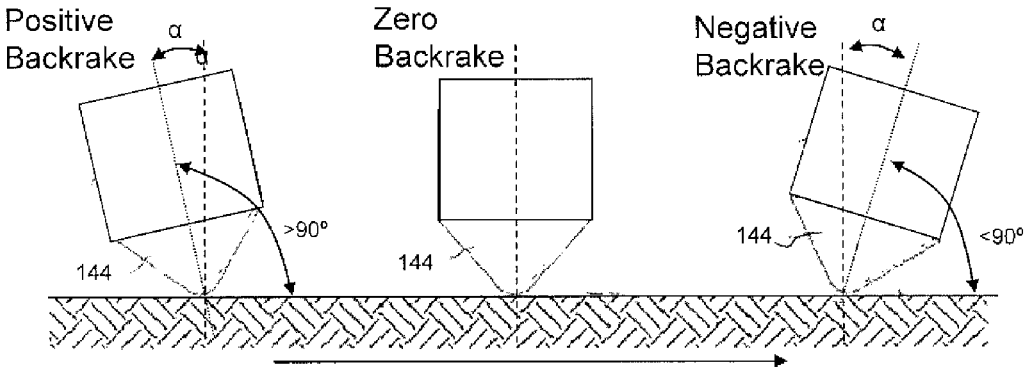
FIG. 9 shows a cutting element according to one embodiment of the present disclosure.

However, conical cutting elements do not have a cutting face and thus the orientation of conical cutting elements must be defined differently. When considering the orientation of conical cutting elements, in addition to the vertical or lateral orientation of the cutting element body, the conical geometry of the cutting end also affects how and the angle at which the conical cutting element strikes the formation. Specifically, in addition to the back rake affecting the aggressiveness of the conical cutting element-formation interaction, the cutting end geometry (specifically, the apex angle and radius of curvature) greatly affect the aggressiveness that a conical cutting element attacks the formation. In the context of a conical cutting element, as shown in FIG. 9, back rake is defined as the angle $\alpha$ formed between the axis of the conical cutting element 144 (specifically, the axis of the conical cutting end) and a line that is normal to the formation material being cut. As shown in FIG. 9, with a conical cutting element 144 having zero back rake, the axis of the conical cutting element 144 is substantially perpendicular or normal to the formation material. A conical cutting element 144 having negative back rake angle $\alpha$ has an axis that engages the formation material at an angle that is less than 90° as measured from the formation material. Similarly, a conical cutting element 144 having a positive back rake angle $\alpha$ has an axis that engages the formation material at an angle that is greater than 90° when measured from the formation material. In a particular embodiment, the back rake angle of the conical cutting elements may be zero, or in another embodiment may be negative or positive. In embodiments, the back rake of the conical cutting elements may range from −35 to 35, from −10 to 10 in other embodiments, from zero to 10 in yet other embodiments, and from −5 to 5 in yet other embodiments. Further, while not necessarily specifically mentioned in the following paragraphs, the back rake angles of the conical cutting elements in the following embodiments may be selected from these ranges.

Figure 10:
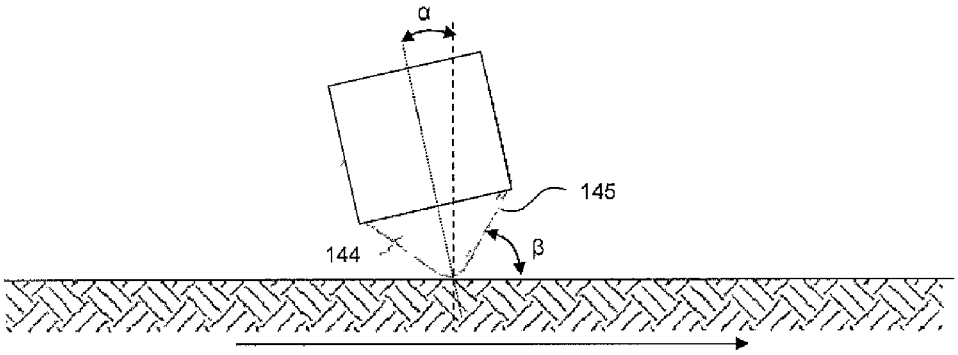
FIG. 10 shows cutting element according to one embodiment of the present disclosure.

In addition to the orientation of the axis with respect to the formation, the aggressiveness of the conical cutting elements may also be dependent on the apex angle or specifically, the angle between the formation and the leading portion of the conical cutting element. Because of the conical shape of the conical cutting elements, there does not exist a leading edge; however, the leading line of a conical cutting surface may be determined to be the firstmost points of the conical cutting element at each axial point along the conical cutting end surface as the bit rotates. Said in another way, a cross-section may be taken of a conical cutting element along a plane in the direction of the rotation of the bit, as shown in FIG. 10. The leading line 145 of the conical cutting element 144 in such plane may be considered in relation to the formation. The strike angle of a conical cutting element 144 is defined to be the angle $\alpha$ formed between the leading line 145 of the conical cutting element 144 and the formation being cut. The strike angle will vary depending on the back rake and the cone angle, and thus, the strike angle of the conical cutting element may be calculated to be the back rake angle less one-half of the cone angle (i.e., $\beta=(0.5*\text{cone angle})+\alpha$), where if the back rake angle $\alpha$ is negative, as described with respect to FIG. 9, the equation will add the negative value to the (0.5*cone angle) value). In embodiments, $\beta$ may range from about 5 to 100 degrees, and from about 20 to 65 in other embodiments. Further, while not necessarily specifically mentioned in the following paragraphs, the strike angles of the conical cutting elements in the following embodiments may be selected from these ranges.

Figure 11A:
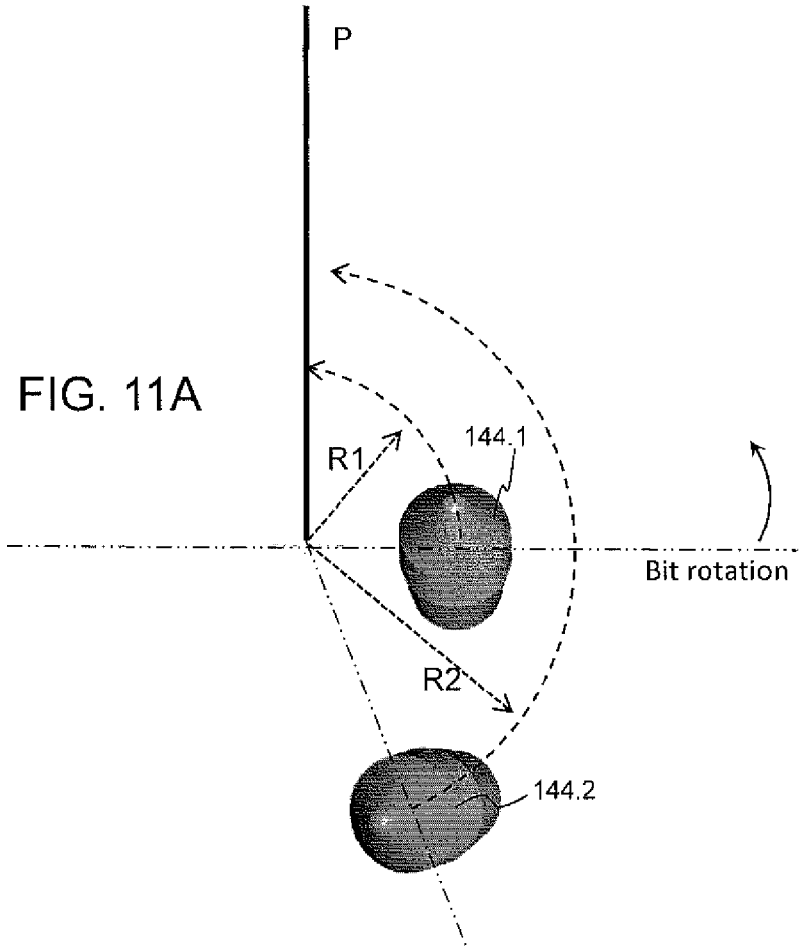
FIG. 11A shows a cutting element layout according to one embodiment of the present disclosure.
Figure 11B:
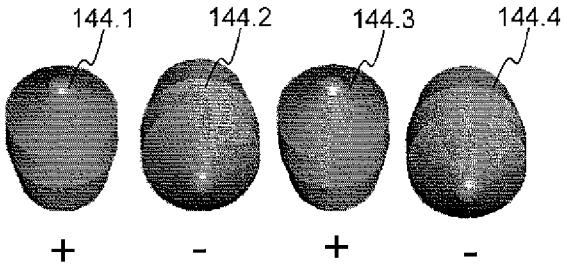
FIG. 11B shows a top view of a cutting element layout of FIG. 11A rotated into a single plane.
Figure 11C:
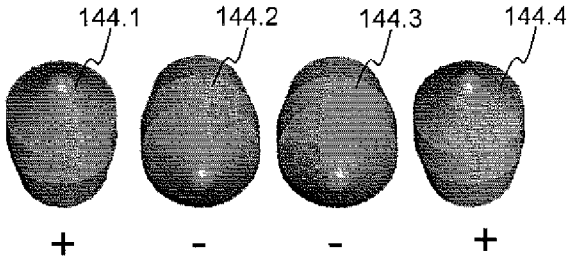
FIG. 11C shows a top view of a cutting element layout of FIG. 11A rotated into a single plane.

Referring now to FIGS. 11A-C, variations of cutting structures used in accordance with the present disclosure are shown. As shown in FIG. 11A, showing the rotation of two conical cutting elements 144, a first conical cutting element 144.1 located at a radial position R1 from the bit centerline may be oriented with a positive back rake, whereas a second conical cutting element 144.2 located at a radial position R2 from the bit centerline is oriented with a negative back rake. In this illustrated embodiment, conical cutting element 144.1 is the first cutting element to rotate through reference plane P, as the bit rotates, and conical cutting element 144.2 is the second cutting element to rotate through reference plane P, as the bit rotates. The back rake angles of conical cutting elements 144.1 and 144.2 may be selected from any of the back rake angles described herein. Further, it is also within the scope of the present disclosure that one or more conventional cutters (not shown in FIG. 11A) may be present at radially intermediate positions between conical cutters 144.1 and 144.2. In this regard, the opposite back rake angles between two radially adjacent conical cutting elements refers to a view of the cutting profile in which only the conical cutting elements are considered. As the present disclosure allows for any two radially adjacent conical cutting elements (when the conical cutting elements are rotated into view onto a single plane) to have opposite back rake angles, this may include for conical cutting elements to have alternating directions of back rake when rotated into a single plane, as shown in FIG. 11B, or any number of pairs of conical cutting elements may have the opposite back rakes, as shown in FIG. 11C.

Optionally, conical cutting elements 144 may be arranged with cutters 142 on a drill bit such that when the cutting elements are viewed in a cutting profile or rotated view into a single plane, at least one cutter 142 is located a radial position from the bit axis that is intermediate the radial positions of at least two conical cutting elements 144, as described in U.S.

Figure 12:
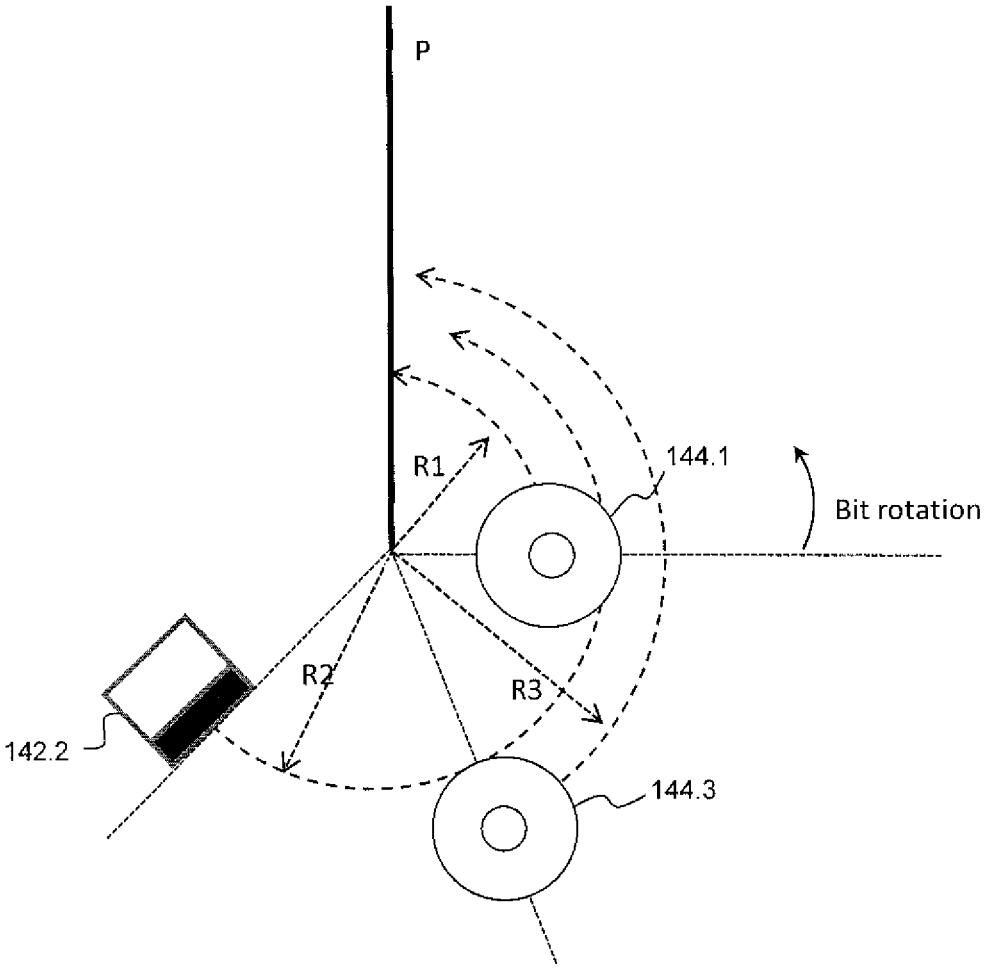
FIG. 12 shows a cutting element layout according to one embodiment of the present disclosure.

Patent Application No. 61/441,319, which is assigned to the present assignee and herein incorporated by reference in its entirety. Specifically, as illustrated in FIG. 12, a first conical cutting element 144.1 at a radial position R1 from the bit centerline is the first cutting element to rotate through reference plane P, as the bit rotates. Conical cutting element 144.3 at a radial position R3 from the bit centerline is the second cutting element to rotate through reference plane P. Cutting element 142.2 at radial position R2 from the bit centerline is the third cutting element to rotate through reference plane P, where R2 is a radial distance intermediate the radial distances of R1 and R3 from the bit centerline. As the bit rotates, cutter 142 passes through formation pre-fractured by conical cutting element 144 to trim the kerf created by conical cutting elements 144.

Figure 13A:
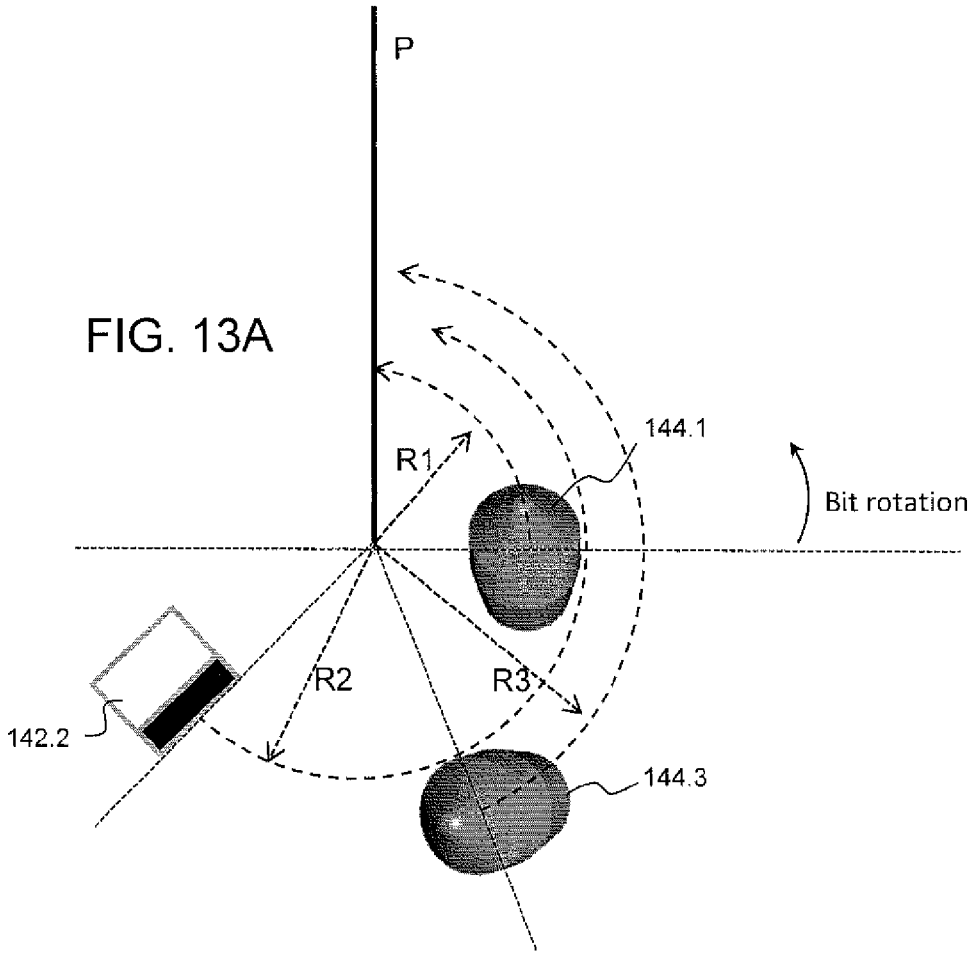
FIGS. 13A-B show cutting element layouts according to one embodiment of the present disclosure.
Figure 13B:
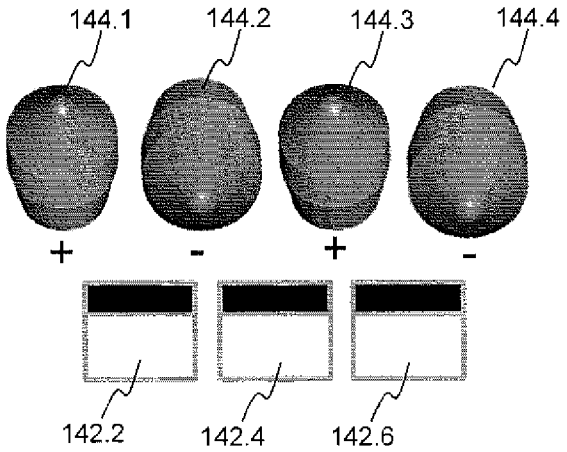

Referring to FIGS. 13A-B, embodiments combining the conical cutting element orientation described with respect to FIG. 11A with the cutter layout described with respect to FIG. 12 are shown. For example, as illustrated in FIG. 13A, a first conical cutting element 144.1 having a positive back rake at a radial position R1 from the bit centerline is the first cutting element to rotate through reference plane P, as the bit rotates. Conical cutting element 144.3 having a negative back rake at a radial position R3 from the bit centerline is the second cutting element to rotate through reference plane P. Cutting element 142.2 at radial position R2 from the bit centerline is the third cutting element to rotate through reference plane P, where R2 is a radial distance intermediate the radial distances of R1 and R3 from the bit centerline. As the bit rotates, cutter 142 passes through formation pre-fractured by conical cutting element 144 to trim the kerf created by conical cutting elements 144. Such a configuration with seven cutting elements (four conical cutting elements 144.1, 144.3, 144.5, 144.7 and three cutters 142.2, 142.4, 142.6) is shown in FIG. 13B.

Figure 14A:
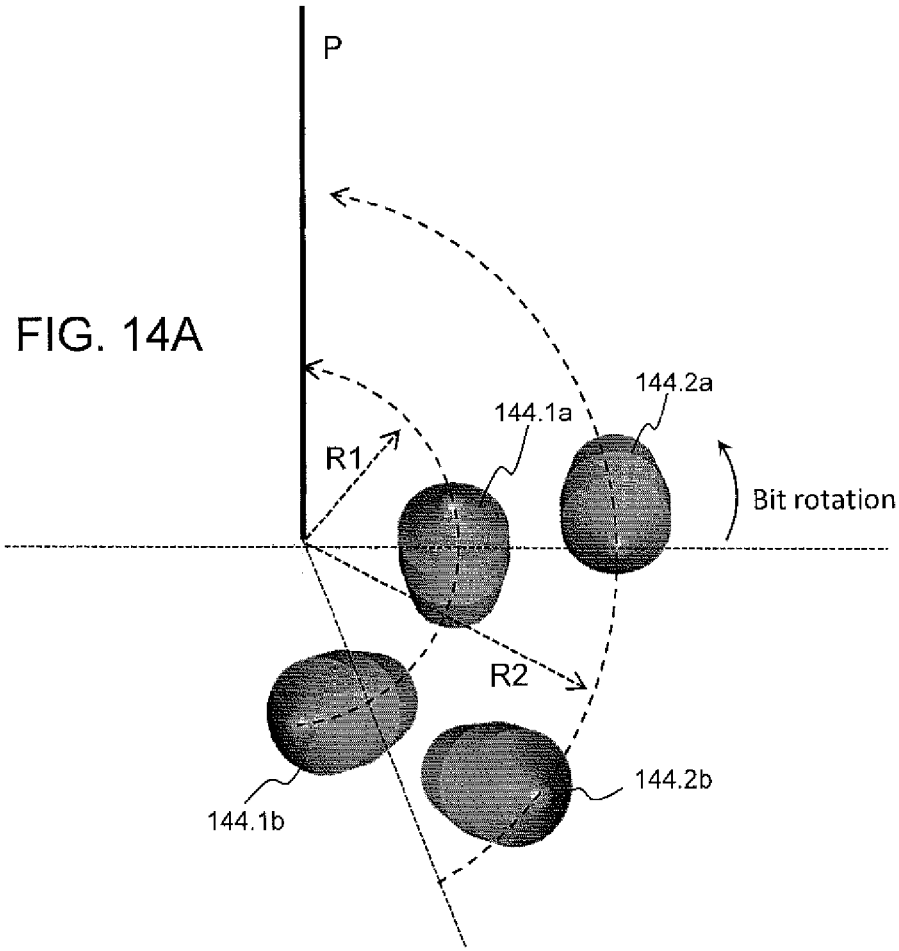
FIGS. 14A-B show cutting element layouts according to one embodiment of the present disclosure.
Figure 14B:
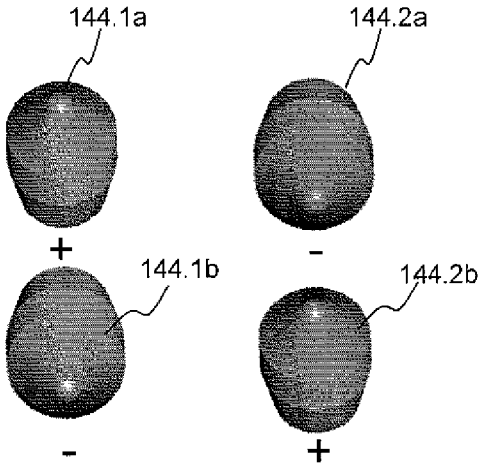

FIGS. 14A-B show yet another variation of cutting structure arrangement using conical cutting elements having back rake angles in opposite directions. Two conventional setting or cutter distribution patterns with respect to PDC cutters are the "single set" method and the "plural set" method. In the "single set" method, each PDC cutter that is positioned across the face of the bit is given a unique radial position measured from the center axis of the bit outwards towards the gage. With respect to a plural set pattern (also known as "redundant cutter" or "tracking cutter" pattern), PDC cutters as deployed in sets containing two or more cutters each, wherein the cutters of a given set are positioned at a same radial distance from the bit axis. As shown in FIG. 14A-B, each radial position includes two conical cutting elements 144. At the first radial position R1, conical cutting element 144.1*a* has a positive back rake, while trailing conical cutting element 144.1*b* has a negative back rake angle. However, the reverse may also be true. For example, at the second radial position R2, conical cutting element 144.2*a* has a negative back rake, while trailing conical cutting element 144.2*b* has a positive back rake angle.

Figure 15:
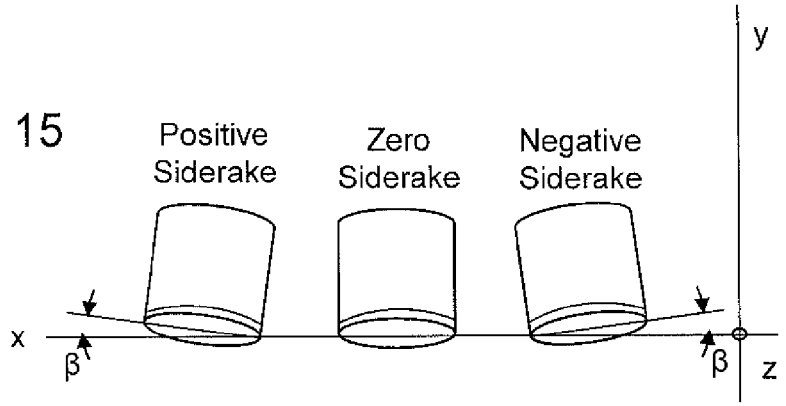
FIG. 15 shows cutting elements according to the present disclosure.

Various embodiments may also use multiple side rakes on the conical cutting elements of the present disclosure. Conventionally for PDC cutters, side rake is defined as the angle between the cutting face and the radial plane of the bit (x-z plane), as illustrated in FIG. 15. When viewed along the z-axis, a negative side rake angle β results from counterclockwise rotation of the cutter, and a positive side rake angle β, from clockwise rotation. In a particular embodiment, the side rake of cutters may range from −30 to 30, and from 0 to 30 in other embodiments.

Figure 16A:
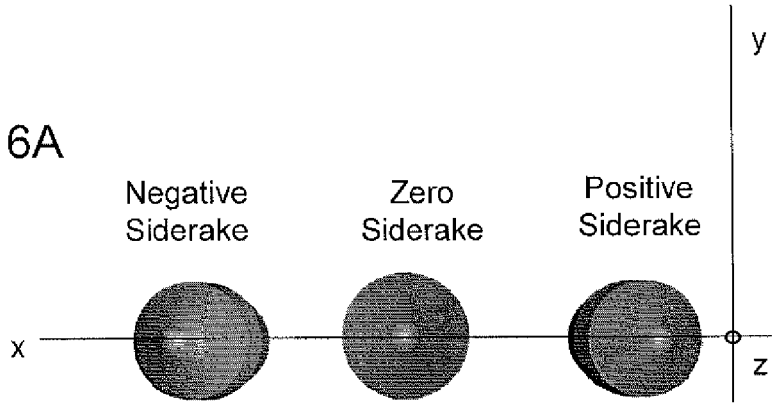
FIGS. 16A-B show top and side views of cutting elements according to the present disclosure.
Figure 16B:
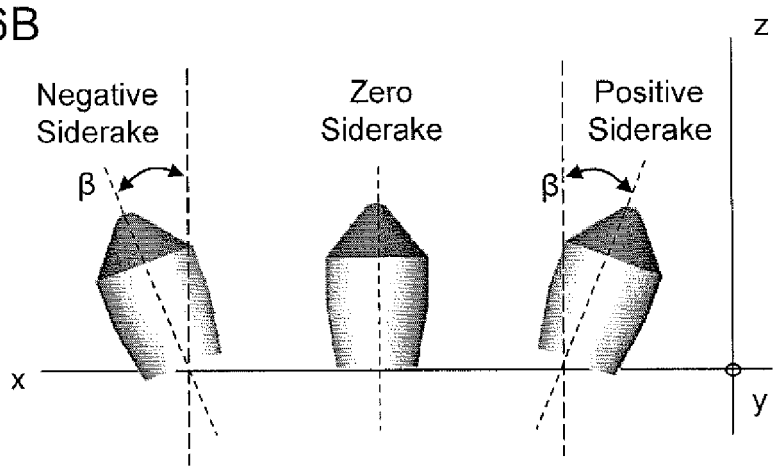

However, conical cutting elements do not have a cutting face and thus the orientation of conical cutting elements must be defined differently. In the context of a conical cutting element, as shown in FIGS. 16A-B, side rake is defined as the angle β formed between the axis of the conical cutting element 144 (specifically, the axis of the conical cutting end) and a line parallel to the bit centerline, i.e., z-axis. As shown in FIGS. 16A-B, with a conical cutting element 144 having zero side rake, the axis of the conical cutting element 144 is substantially parallel to the bit centerline. A conical cutting element 144 having negative side rake angle β has an axis that is pointed away from the direction of the bit centerline. Conversely, a conical cutting element 144 having a positive side rake angle β has an axis that points towards the direction of the bit centerline. The side rake of the conical cutting elements may range from about −30 to 30 in various embodiments and from −10 to 10 in other embodiments. Further, while not necessarily specifically mentioned in the following paragraphs, the side rake angles of the conical cutting elements in the following embodiments may be selected from these ranges.

Figure 17:
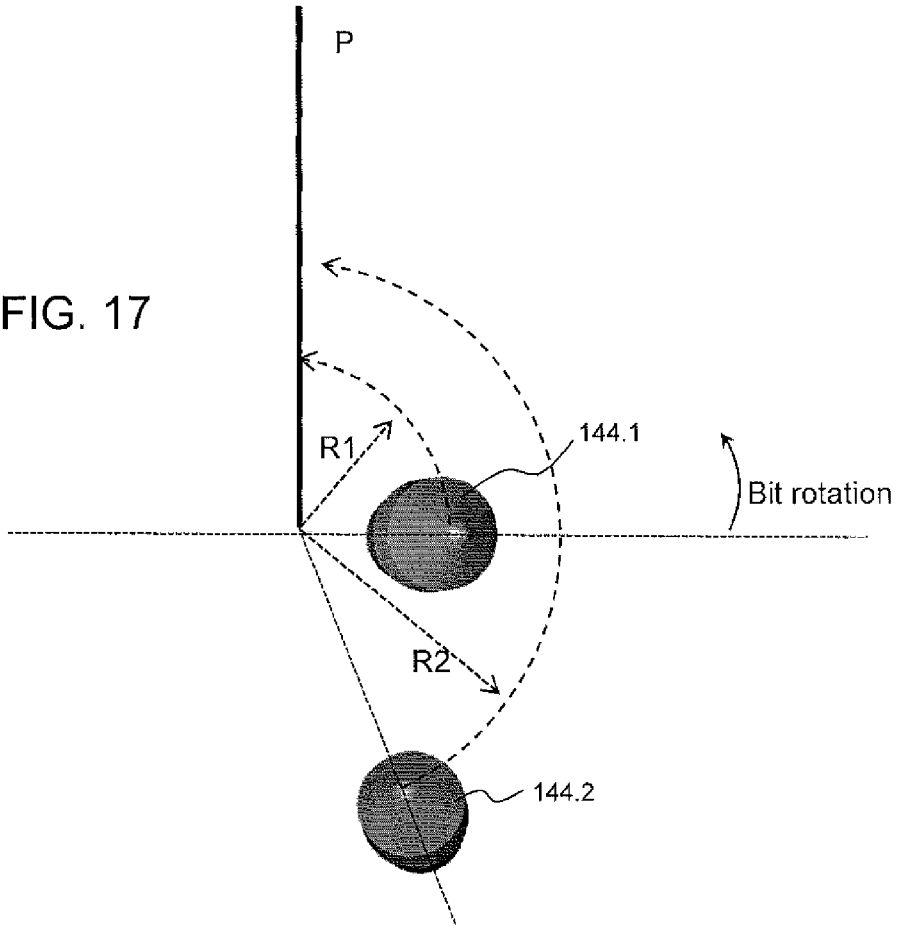
FIG. 17 shows a cutting element layout according to one embodiment of the present disclosure.

Referring now to FIG. 17, a variation of cutting structures used in accordance with the present disclosure is shown. As shown in FIG. 17, showing the rotation of two conical cutting elements 144, a first conical cutting element 144.1 located at a radial position R1 from the bit centerline may be oriented with a negative side rake, whereas a second conical cutting element 144.2 located at a radial position R2 from the bit centerline is oriented with a positive side rake. In this illustrated embodiment, conical cutting element 144.1 is the first cutting element to rotate through reference plane P, as the bit rotates, and conical cutting element 144.2 is the second cutting element to rotate through reference plane P, as the bit rotates. The side rake angles of conical cutting elements 144.1 and 144.2 may be selected from any of the side rake angles described herein. Further, it is also within the scope of the present disclosure that one or more conventional cutters (not shown in FIG. 17) may be present at radially intermediate positions between conical cutters 144.1 and 144.2. In this regard, the opposite side rake angles between two radially adjacent conical cutting elements refers to a view of the cutting profile in which only the conical cutting elements are considered. As the present disclosure allows for any two radially adjacent conical cutting elements (when the conical cutting elements are rotated into view onto a single plane) to have opposite side rake angles, this may include for conical cutting elements to have alternating directions of side rake when rotated into a single plane, or any number of pairs of conical cutting elements may have the opposite side rakes.

Figure 18A:
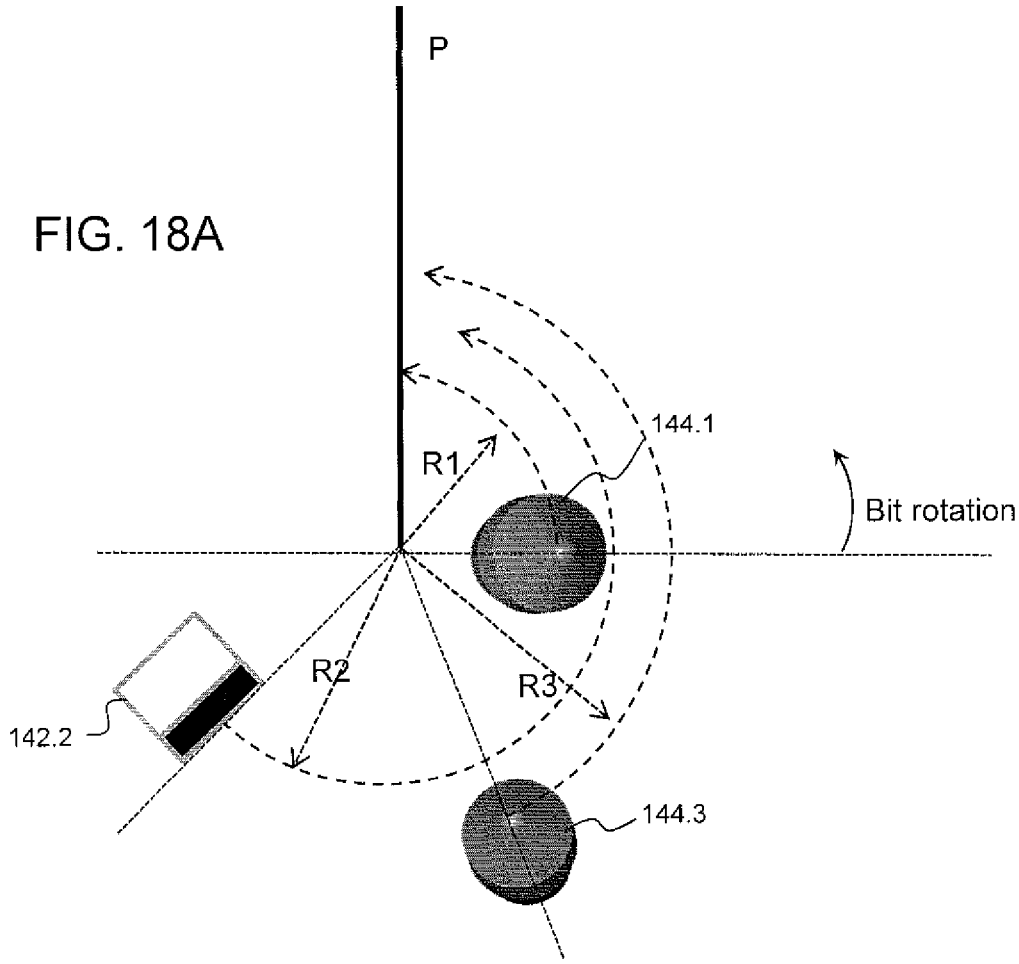
FIGS. 18A-B show cutting element layouts according to one embodiment of the present disclosure.
Figure 18B:
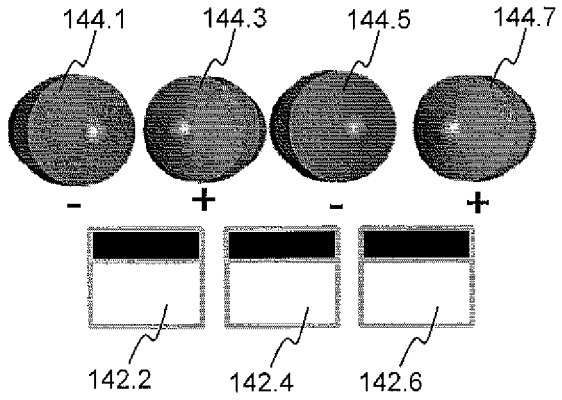
Figure 19A:
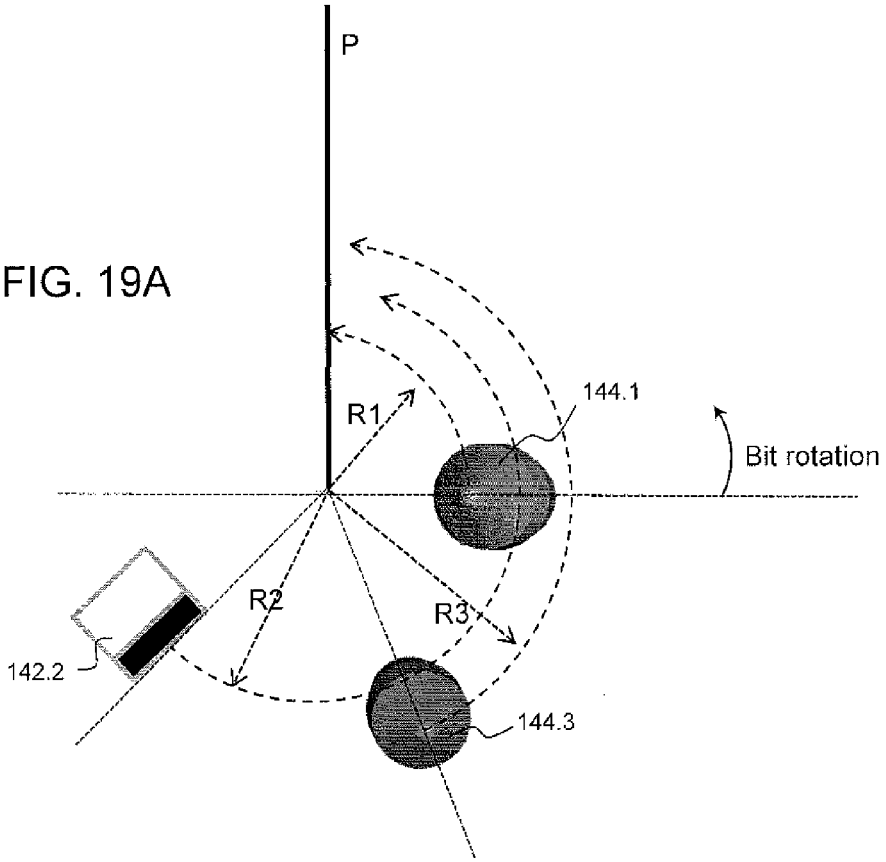
FIGS. 19A-B show cutting element layouts according to one embodiment of the present disclosure.
Figure 19B:
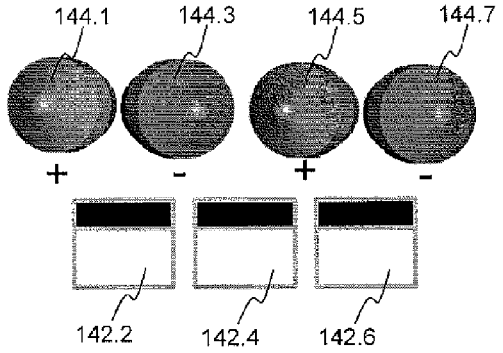

Referring to FIGS. 18A-B, embodiments combining the conical cutting element orientation described with respect to FIG. 11A with the cutter layout described with respect to FIG. 17 are shown. For example, as illustrated in FIG. 18A, a first conical cutting element 144.1 having a negative side rake at a radial position R1 from the bit centerline is the first cutting element to rotate through reference plane P, as the bit rotates. Conical cutting element 144.3 having a positive side rake at a radial position R3 from the bit centerline is the second cutting element to rotate through reference plane P. Cutting element 142.2 at radial position R2 from the bit centerline is the third cutting element to rotate through reference plane P, where R2 is a radial distance intermediate the radial distances of R1 and R3 from the bit centerline. As the bit rotates, cutter 142 passes through formation pre-fractured by conical cutting element 144 to trim the kerf created by conical cutting elements 144. Such a configuration with seven cutting elements (four conical cutting elements 144.1, 144.3, 144.5, 144.7 and three cutters 142.2, 142.4, 142.6) is shown in FIG. 18B. In the embodiment shown in FIG. 18A-B, the pairs of conical cutting elements 144.1, 144.3, through which cutter 142.2 passes (and pairs of conical cutting elements 144.5, 144.7 with cutter 142.6), are pointed toward each other and the R2 (or R6) position. Conversely, pairs of conical cutting elements 144.3, 144.5, though which cutter 142.4 passes, are pointed away from each other and the R4 position. As the present disclosure allows for any two radially adjacent conical cutting elements (when the conical cutting elements are rotated into view onto a single plane), through which an intermediate cutter passes, to have opposite side rake angles, this may include for conical cutting elements to have, compared to the embodiment illustrated in FIG. 18A-B, conical cutting elements 144 having the opposite side rake pattern (i.e., conical cutting element 144.1 has a positive side rake, and each subsequent radially adjacent conical cutter has a side rake angle alternating in direction) when rotated into a single plane, as shown in FIG. 19A-B, or any number of pairs of conical cutting elements may have the opposite side rakes. Further, it is also within the scope of the present disclosure that a cutter 142 could be omitted at any radially intermediate position, for example, so that all triads of two conical cutting elements and a cutter can have the conical cutting elements pointing towards or away from the radially intermediate cutter.

Figure 20A:
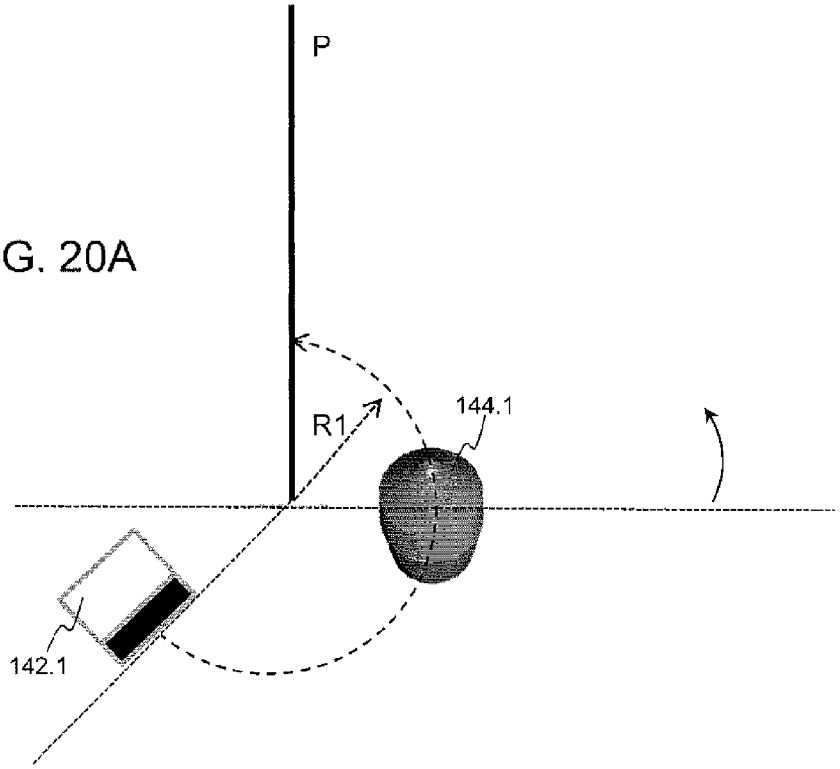
FIGS. 20A-B show cutting element layouts according to one embodiment of the present disclosure.
Figure 20B:
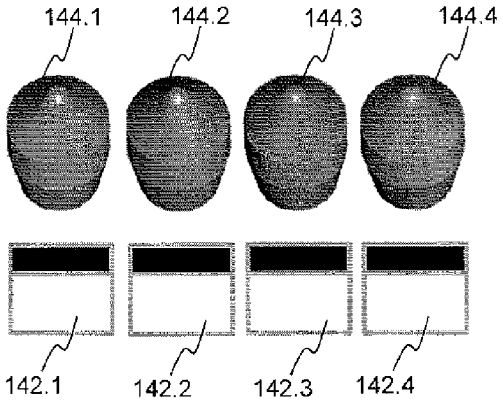

Further, while it was mentioned earlier that one or more conical cutting elements may be a redundant or tracking cutting element to another conical cutting element in a plural set cutting element arrangement, it is also within the scope of the present disclosure that a cutter 142 may track a conical cutting element 144, or vice versa. For example, as shown in FIGS. 20A-B, each radial position (i.e., R1) includes a conical cutting element 144 and a cutter 142 trailing the conical cutting element 144. In this embodiment, the conical cutting element 144 may create troughs, which each side of which are then trimmed by the cutter 142. However, the reverse may also be true. Further, while each conical cutting element is illustrated has having a positive back rake angle and no side rake angle, it is within the scope of the present disclosure that any type or combination of back rake angles and/or side rake angles, such as those described herein, may be used in such embodiment.

Figure 21A:
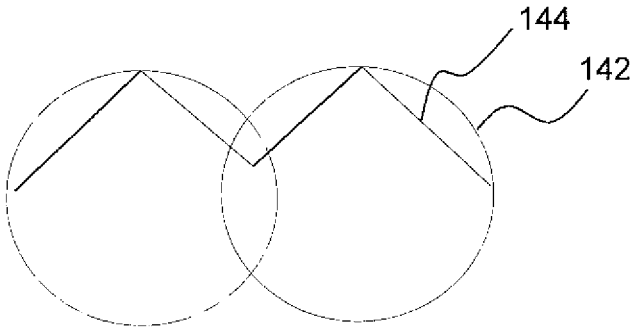
FIGS. 21A-C show cutting element exposures according to one embodiment of the present disclosure.
Figure 21B:
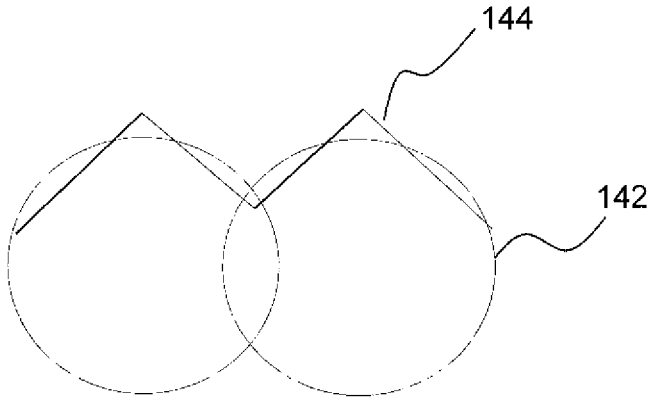
Figure 21C:
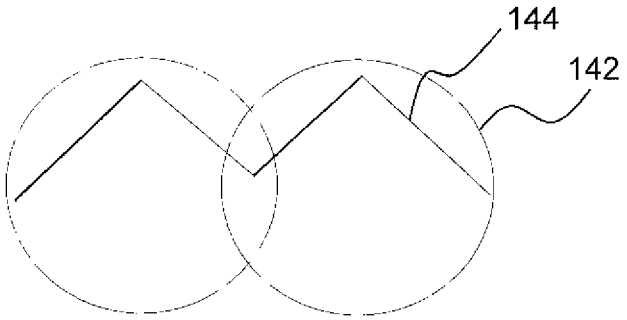

Further, when using a plural set of cutting elements, where a conical cutting element is tracked by a cutter, or vice versa, referring now to FIG. 21A-C, it is also within the scope of the present disclosure that cutters 142 and conical cutting elements 144 may be set at the same or different exposure heights. In FIG. 21A, the conical cutting elements 142 and the cutters are set at the same exposure height, whereas FIG. 21B shows an embodiment where conical cutting element is set at a greater exposure height than cutter 142 and FIG. 21C shows an embodiment where cutter 142 is set with a greater exposure height than conical cutting element 144. The selection of exposure height difference may be based, for example, on the type of formation to be drilled. For example, a conical cutting element 144 with a greater exposure height may be preferred when the formation is harder, whereas, cutters 142 with a greater exposure height may be preferred when the formation is softer. Further, the exposure difference may allow for better drilling in transition between formation types. If a cutter has a greater exposure height (for drilling through a softer formation), it may dull when a different formation type is hit, and the dulling of the cutter may allow for engagement of the conical cutting element. In embodiments, such exposure height differences may range from ±0.25 inches and from ±0.1 inch in other embodiments.

Figure 22A:
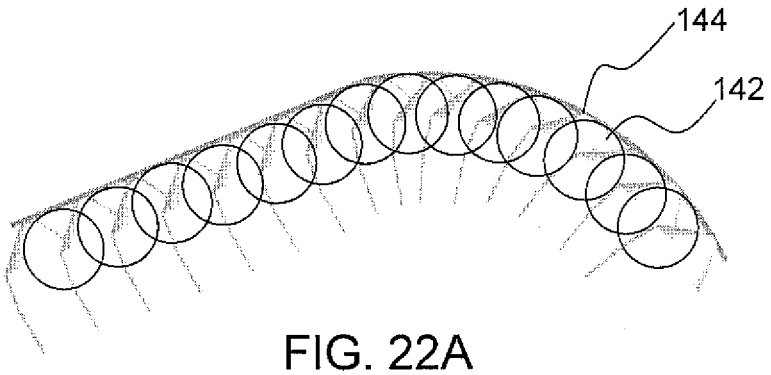
FIGS. 22A-C show a cutting profile according to one embodiment of the present disclosure.
Figure 22B:
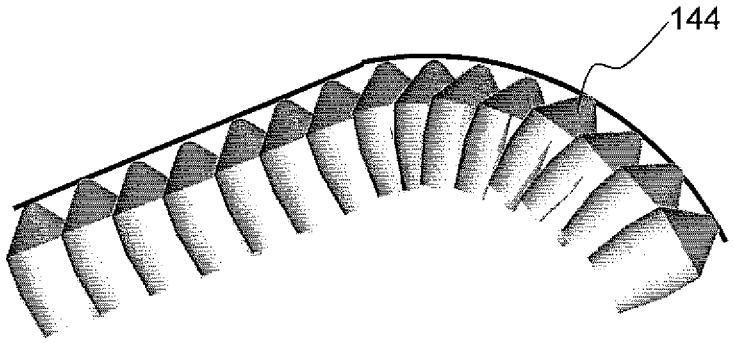
Figure 22C:
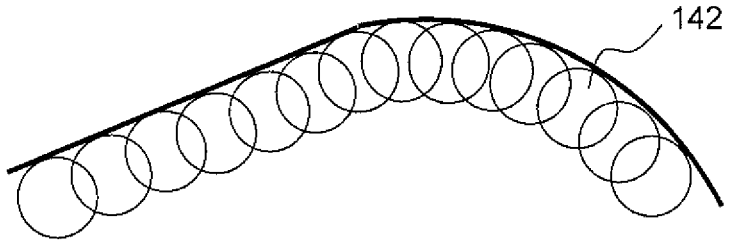
Figure 23:
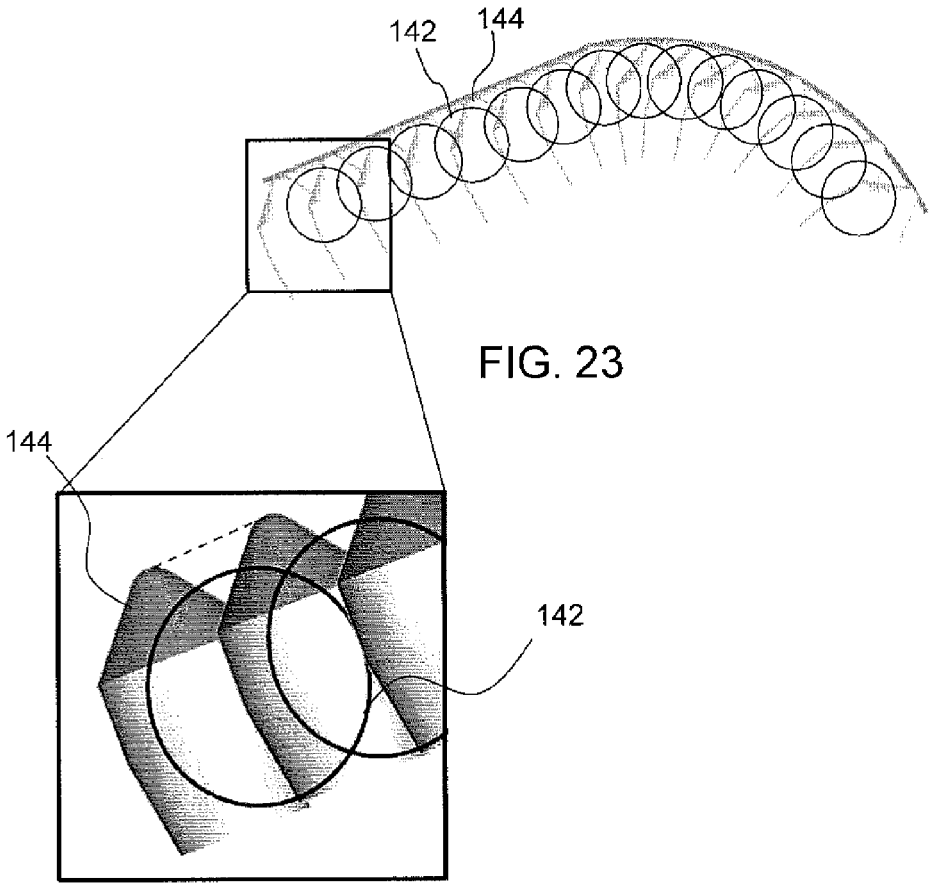
FIG. 23 shows a cutting profile according to one embodiment of the present disclosure.

Further, while the embodiments in FIGS. 21A-C illustrate a plural set of cutting elements, it is also within the scope of the present disclosure that single sets of cutting elements may also utilize such exposure height variations. Referring now to FIG. 22A-C, a single set of cutting elements that includes both conical cutting elements 144 and cutters 142 is shown. In this embodiment, conical cutting elements 144 and cutters 142 have the same exposure height. Further, the conical cutting elements 144 and cutters are alternated at sequential radial positions, and each set of the conical cutting elements 144 and cutters 142 form a full bottom hole coverage (shown in FIGS. 22B-C) when considered alone, but are combined to form a single cutting profile, also having full bottom hole coverage. Referring now to FIG. 23, a similar alternating arrangement of cutters 142 and conical cutting elements 144 is shown providing full bottom hole coverage. However, the conical cutting elements 144 are at a greater exposure height than cutters 142. While not specifically illustrated, the reverse difference in exposure height may also be used. Further, while these embodiments illustrate a substantially constant exposure height difference between the two types of cutting elements, the present disclosure is not limited. Rather, the exposure height may transition along the cutting profile so that, for example, any of the cone, nose, shoulder, or gage have higher or lower relative exposure height differences. Such transition may be smooth or stepped.

Figure 24:
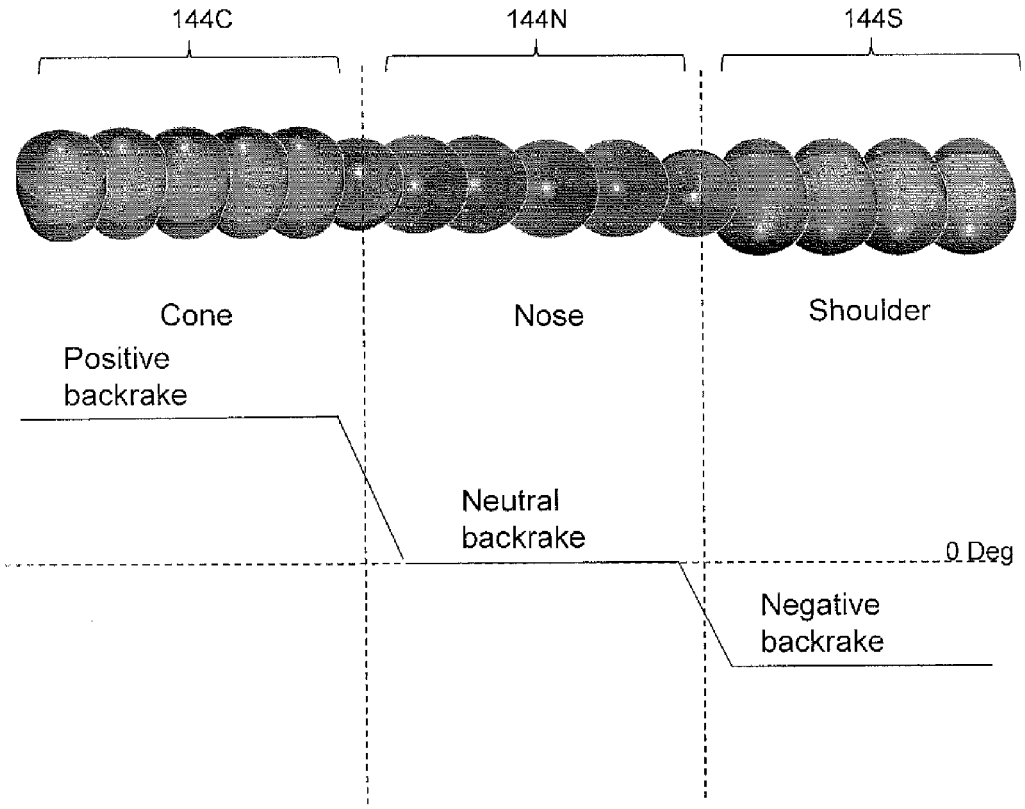
FIG. 24 shows a cutting profile according to one embodiment of the present disclosure.

Referring now to FIG. 24, another embodiment of a cutting profile in accordance with the present disclosure is shown. As discussed above, the direction of the back rake angle may be selected based on the radial location of the conical cutting elements along the cutting profile. For example, referring to FIG. 24, a cutting profile of conical cutting elements 144 rotated into a single plane is shown. The conical cutting elements 144C in the cone region of the profile are provided with a positive back rake angle, the conical cutting elements 144N in the nose region of the profile are provided with a neutral or substantially no back rake angle, and the conical cutting elements 144S in the shoulder region of the profile are provided with a negative back rake angle. Further, while the conical cutting elements 144 in each region is illustrated as having substantially the same back rake angle, the present disclosure is not so limited. Rather, it is envisioned that there may be variations in the extent of back rake angle within each region of the cutting profile. Further, while no cutters are shown in this embodiment, it is within the scope of the present disclosure that cutters may optionally be included on the bit, at radially intermediate locations or as a plural set, tracking the conical cutting elements 144.

Figure 25:
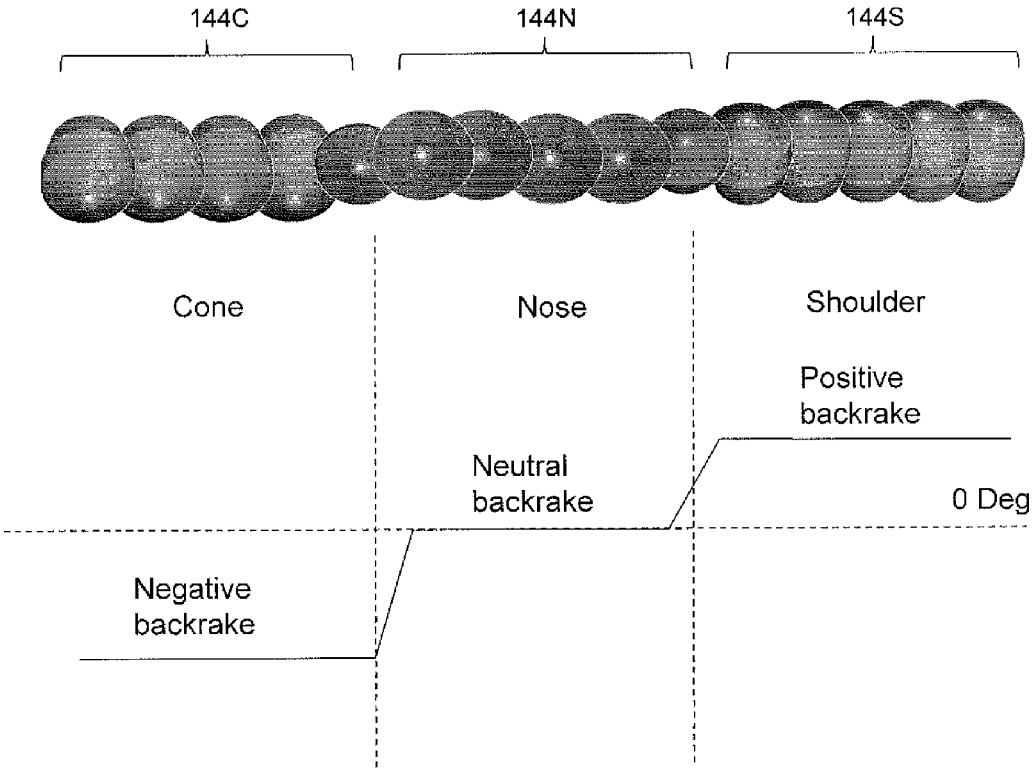
FIG. 25 shows a cutting profile according to one embodiment of the present disclosure.

Additionally, while the embodiment shown in FIG. 24 transitions from a positive back rake to negative back rake moving away from the bit centerline, another embodiment of the present disclosure includes a transition from negative back rake to positive back rake, moving away from the bit centerline. Specifically, referring to FIG. 25, a cutting profile of conical cutting elements 144 rotated into a single plane is shown. The conical cutting elements 144C in the cone region of the profile are provided with a negative back rake angle, the conical cutting elements 144N in the nose region of the profile are provided with a neutral or substantially no back rake angle, and the conical cutting elements 144S in the shoulder region of the profile are provided with a positive back rake angle. Further, while the conical cutting elements 144 in each region is illustrated as having substantially the same back rake angle, the present disclosure is not so limited. Rather, it is envisioned that there may be variations in the extent of back rake angle within each region of the cutting profile. Further, while no cutters are shown in this embodiment, it is within the scope of the present disclosure that cutters may optionally be included on the bit, at radially intermediate locations or as a plural set, tracking the conical cutting elements 144. When selecting different back rake angles for different regions of the bit, the selection may depend, for example, on where aggressive or passive cutting action is desired. A positive backrake angle may be selected for regions of the bit where an aggressive cutting is desired, whereas a negative back rake may be selected for regions of the bit where a more passing cutting is desired.

Further, while all of the embodiments illustrated thus far show a smooth cutting profile, the present disclosure is not so limited. Rather, referring now to FIG. 26, one embodiment of a non-smooth or sawtooth cutting profile is shown. As shown in FIG. 26, conical cutting elements 144 may be placed on the bit (or the blade may have a similar profile) so that a non-smooth, sawtooth profile is achieved. As used herein, a non-smooth cutting profile refers to a profile created by lines tangent to the apexes of the conical cutting elements and/or the cutting edges of the cutters rotated into a single plane such that the profile contains at least one vertex. Specifically, to achieve the cutting profile illustrated in FIG. 26, the first three (radially located) conical cutting elements 144.1-144.3 form a substantially linear profile that is "flat" (co-planar) or with a slight angle with respect to a plane perpendicular to the bit centerline. Conical cutting element 144.4 is at an exposure height greater than conical cutting elements 144.1-144.3 to create an angular step in the cutting profile. Cutting elements 144.5, 144.6 form a substantially linear profile with conical cutting element 144.4 that is "flat" or with a slight angle with respect to a plane perpendicular to the bit centerline. Beginning at conical cutting element 144.7 and continuing radially outward to the gage of the bit, the conical cutting elements 144.7-144.15 form a smooth, arcuate cutting profile.

Further, while embodiment illustrated in FIG. 26 has a cutting profile shape determined by conical cutting elements, including the creation of a stepped profile, other embodiments may use a combination of conical cutting elements and cutters to create a profile shape. As shown in FIG. 27, extending from a bit centerline L, a plurality of cutters 142 extend radially outward at a first profile shape S1 until reaching first conical cutting element 144.4, which transitions the profile shape due to the apex and cone angle of the conical cutting element 144.4 as well as its exposure height. This second stage or step S2 of the cutting profile is supported by two cutters 142, and beyond the second stage S2, four other of such steps or stages (S3-S6) in the cutting profile are also included by a similar manner to create a multi-stepped non-smooth cutting profile. Specifically, conical cutting elements 144 transition between S1 and S2, S3 and S4, and S5 and S6, whereas cutters 142 transition between S2 and S3 and S4 and S5. While cutters 142 can be used to create a concave angular step in the cutting profile (such as the transition from the S2 to S3), conical cutting elements 144 may be particularly useful for creating convex, angled steps in the profile, such as from S1 to S2. However, one or more of the concave transitions (such as from S2 to S3 may alternatively be achieved by use of a conical cutting element.

Figure 28:
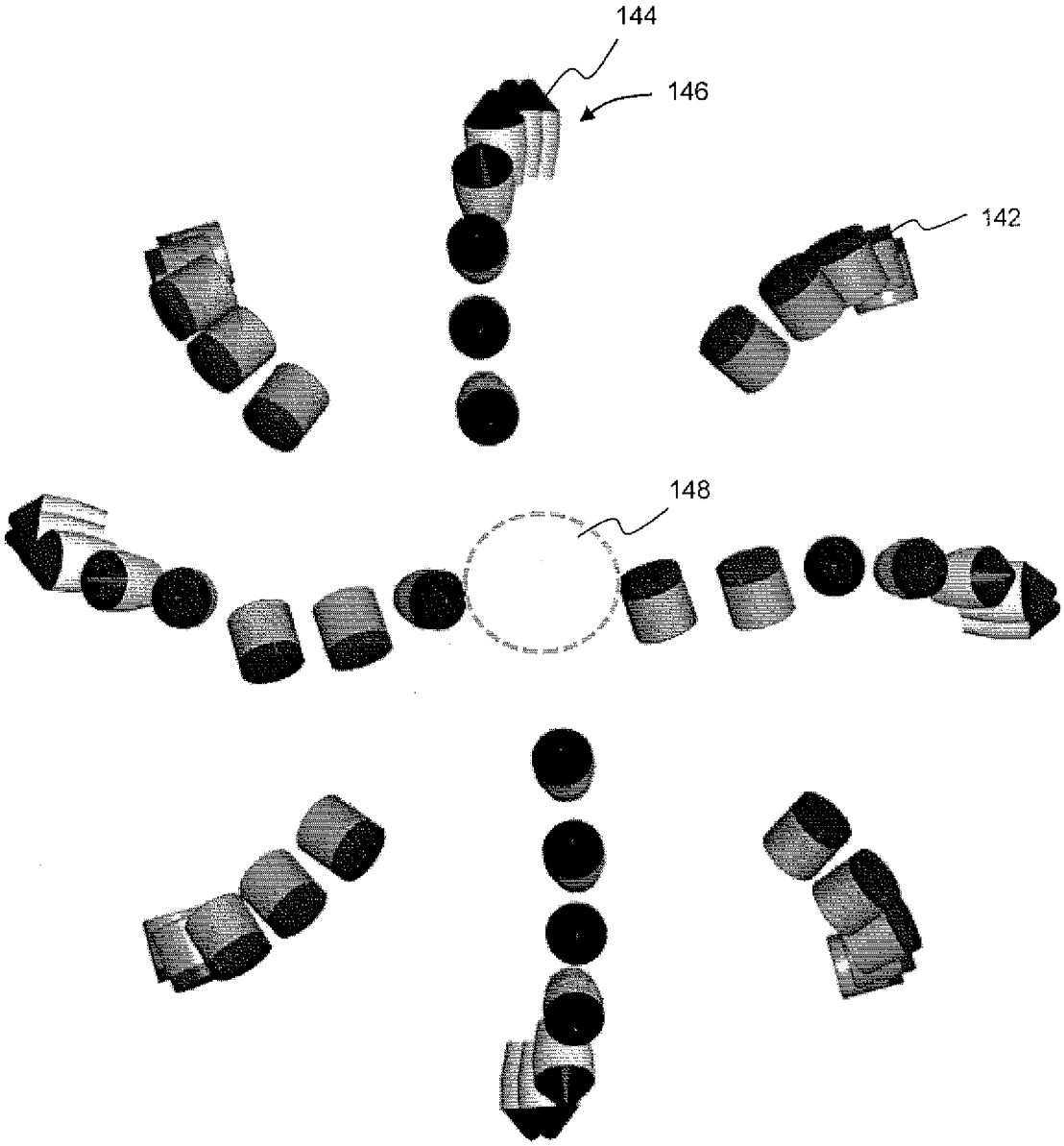
FIG. 28 shows a cutting element layout according to one embodiment of the present disclosure.

While the various embodiments show cutting elements extending substantially near the centerline of the drill bit (and/or blades that intersect the centerline), it is also within the scope of the present disclosure that a center region of the bit may be kept free of cutting structures (and blades). An example cutting element layout of such a drill bit is shown in FIG. 28. Referring to FIG. 28, cutters 142 and conical cutting element 144 are located on blades 146 that do not intersect the centerline of the bit, but rather form a cavity in this center portion 148 of the bit between the blades free of cutting elements. Alternatively, various embodiments of the present disclosure may include a center core cutting element, such as the type described in U.S. Pat. No. 5,655,614, assigned to the present assignee and herein incorporated by reference in its entirety. Such a cutting element may have either a cylindrical shape, similar to cutters 142, or a conical cutting end, similar to conical cutting elements 144. The latter embodiment is illustrated in FIG. 29.

Figure 29:
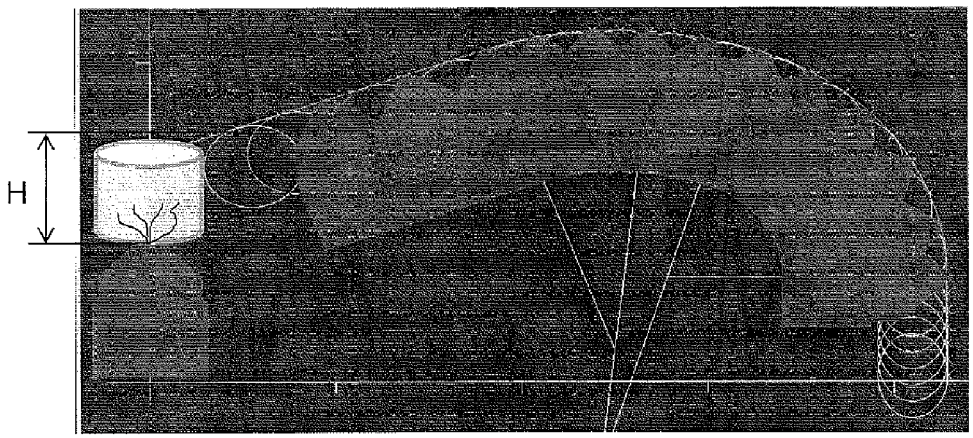
FIG. 29 shows a cutting profile according to one embodiment of the present disclosure.

Referring now to FIG. 29, a cutting profile may include a plurality of cutters 142 and/or a plurality of conical cutting elements 144, in any of the configurations described above or any other configuration. At or adjacent the bit centerline L, a conical cutting element is included as a center coring element 146. Such a coring element is attached directly to the bit body (not shown) in a cavity formed between the blades instead of to a blade (as conical cutting elements 144 and cutters 142 are attached). In accordance with the present disclosure, the center conical coring element 146 may be set to have its apex lower than the cutting edge of the first radial cutting element (whether it is a conical cutting element or cutter). In a particular embodiment, the apex of conical coring element 146 may be at a height H less than the cutting edge of the first radial cutting element, as illustrated in FIG. 29. Height H may range from 0 to 1 inch in some embodiments, from 0.1 inches up to (0.35*bit diameter) in other embodiments, or up to (0.1*bit diameter). Additionally, the conical coring element may have a cone angle ranging from 60 to 120 in some embodiments, or from 80 to 90 in yet other embodiments. The diameter of the conical coring element may range from 0.25 to 1.5 inches and from 0.3 to 0.7 inches in other embodiment. Further, the ratio of H to the diameter of the conical cutting element may range from about 0.1 to 6 or from about 0.5 to 3 in other embodiments Further, the diameter of a central core or cavity in which the conical coring element is disposed (i.e., the region between the plurality of blades) may be up to 3 times the diameter of the conical coring element.

Figure 31A:
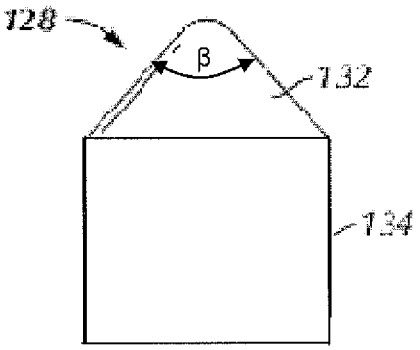
FIG. 31A-C shows various conical cutting elements according to the present disclosure.

Further, while the embodiment shown in FIG. 29 indicates that the conical coring element 146 is disposed on the bit centerline, embodiments of the present disclosure may include a conical cutting element adjacent a bit centerline, i.e., spaced from 0 to up to the value of the radius of the conical coring insert (for symmetrical inserts). However, the present disclosure also includes the use of asymmetrical conical coring inserts (similar to the geometry shown in FIG. 31C), in which case the distance from the bit centerline may range from zero to up to the sum of the radius of the conical coring insert plus the offset between the apex of the conical cutting end and the insert centerline. Further, while the embodiment shown in FIG. 29 shows the conical coring element being inserted so that its axis is coaxial with or parallel with a bit centerline, it is also within the scope of the present disclosure that the centerline of the coring conical insert is angled with respect to the bit centerline. Such angled insertion may be particularly useful when using an asymmetrical conical coring insert. The conical coring insert may be inserted into a hole in the center region of a bit such that the upper extent of the cylindrical base of the conical coring element (i.e., 134, as shown in FIG. 31A) is ±0.1 inches from the bit surface, and is preferably flush with the bit surface in various embodiments.

Figure 30A:
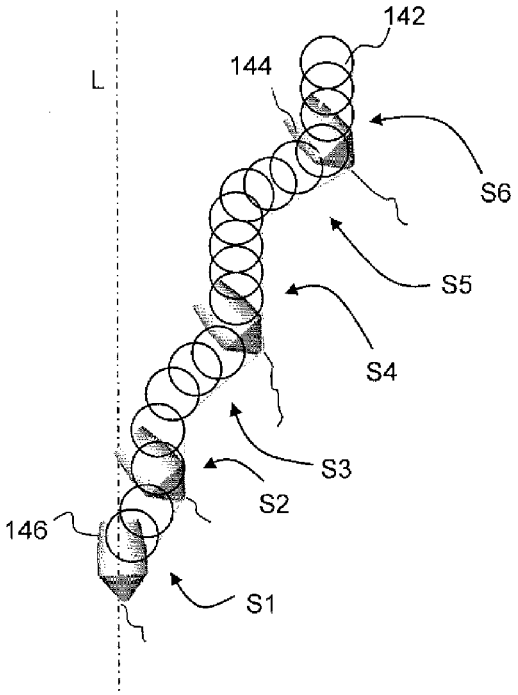
FIGS. 30A-B show a cutting profiles according to the present disclosure.
Figure 30B:
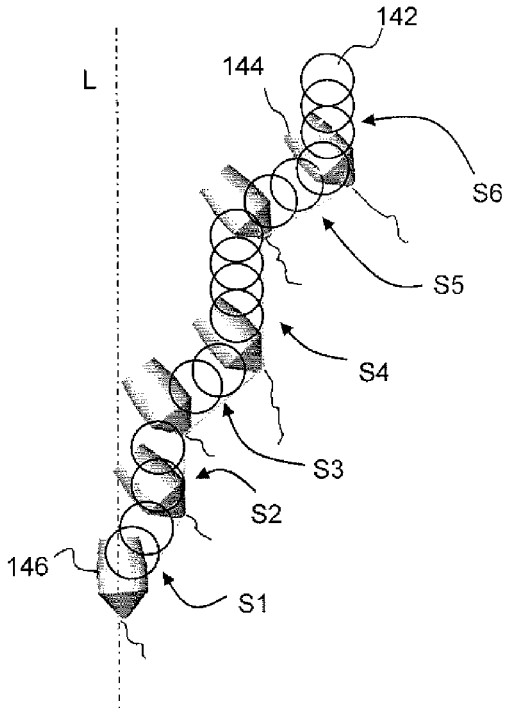

Referring now to FIGS. 30A-B, further embodiments of stepped cutting profile in accordance with the present disclosure. In the embodiments shown in FIGS. 30A-B, a center conical coring cutting element 146 is present along the bit centerline L. Extending radially from the bit centerline L, FIG. 30A contains a similar profile as illustrated in FIG. 27.

As shown in FIG. 30A, a plurality of cutters 142 extend radially outward at a first profile shape S1 until reaching first conical cutting element 144.4, which transitions the profile shape due to the apex and cone angle of the conical cutting element 144.4 as well as its exposure height. This second stage or step S2 of the cutting profile is supported by two cutters 142, and beyond the second stage S2, four other of such steps or stages (S3-S6) in the cutting profile are also included by a similar manner to create a multi-stepped non-smooth cutting profile. Specifically, conical cutting elements 144 transition between S1 and S2, S3 and S4, and S5 and S6 to create the convex portions of the profile, whereas cutters 142 transition between S2 and S3 and S4 and S5 to create the concave portions of the profile.

Referring now to FIG. 30B, extending from a bit centerline, a plurality of cutters 142 extend radially outward at a first profile shape S1 until reaching first conical cutting element 144, which transitions the profile shape due to the apex, cone angle, and exposure height of the conical cutting element 144. This second stage or step S2 is supported by two cutters 142, after which subsequent transitions between each stage S2-S6 is created by conical cutting elements 144, while cutters 142 form the linear portions of each stage or step. Further, while the embodiments shown in FIGS. 27 and 30A-B only use conical cutting elements 144 to create transitions between subsequent stages, it is also within the scope of the present disclosure that conical cutting elements may be set at substantially the same exposure heights as cutters so that conical cutting elements contribute to the linear (or arcuate) portions of a cutting profile.

In another aspect, the use of conical cutting elements 144 with cutters 142 may allow for cutters 142 to have a smaller beveled cutting edge than conventionally suitable for drilling (a bevel large enough to minimize likelihood of chipping). For example, cutters 142 may be honed (~0.001 inch bevel length) or may possess a bevel length of up to about 0.005 inches. However, it is also within the present disclosure that larger bevels (greater than 0.005 inches) may be used.

Further, various embodiments of the present disclosure may also include a diamond impregnated cutting means. Such diamond impregnation may be in the form of impregnation within the blade or in the form of cutting elements formed from diamond impregnated materials. Specifically, in a particular embodiment, diamond impregnated inserts, such as those described in U.S. Pat. No. 6,394,202 and U.S. Patent Publication No. 2006/0081402, frequently referred to in the art as grit hot pressed inserts (GHIs), may be mounted in sockets formed in a blade substantially perpendicular to the surface of the blade and affixed by brazing, adhesive, mechanical means such as interference fit, or the like, similar to use of GHIs in diamond impregnated bits, as discussed in U.S. Pat. No. 6,394,202, or inserts may be laid side by side within the blade. Further, one of ordinary skill in the art would appreciate that any combination of the above discussed cutting elements may be affixed to any of the blades of the present disclosure. In a particular embodiment, at least one preformed diamond impregnated inserts or GHIs may be placed in a backup position to (i.e., behind) at least one conical cutting element. In another particular embodiment, a preformed diamond impregnated insert may be placed at substantially the same radial position in a backup or trailing position to each conical cutting element. In a particular embodiment, a preformed diamond impregnated insert is placed in a backup or trailing position to a conical cutting element at a lower exposure height than the conical cutting element. In a particular embodiment, the diamond impregnated insert is set from about 0.030 to 0.100 inches below the apex of the conical cutting element. Further, the diamond impregnated inserts may take a variety shapes. For example, in various embodiments, the upper surface of the diamond impregnated element may be planar, domed, or conical to engage the formation. In a particular embodiment, either a domed or conical upper surface.

Such embodiments containing diamond impregnated inserts or blades, such impregnated materials may include super abrasive particles dispersed within a continuous matrix material, such as the materials described below in detail. Further, such preformed inserts or blades may be formed from encapsulated particles, as described in U.S. Patent Publication No. 2006/0081402 and U.S. application Ser. Nos. 11/779,083, 11/779,104, and 11/937,969. The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, certain portions of the blade may be impregnated with particles selected to result in a more abrasive leading portion as compared to trailing portion (or vice versa).

The impregnated particles may be dispersed in a continuous matrix material formed from a matrix powder and binder material (binder powder and/or infiltrating binder alloy). The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials. Further, even in embodiments in which diamond impregnation is not provided (or is provided in the form of a preformed insert), these matrix materials may also be used to form the blade structures into which or on which the cutting elements of the present disclosure are used.

Figure 31B:
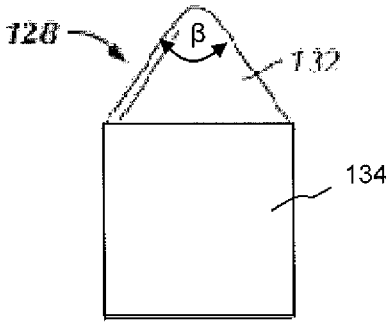
Figure 31C:
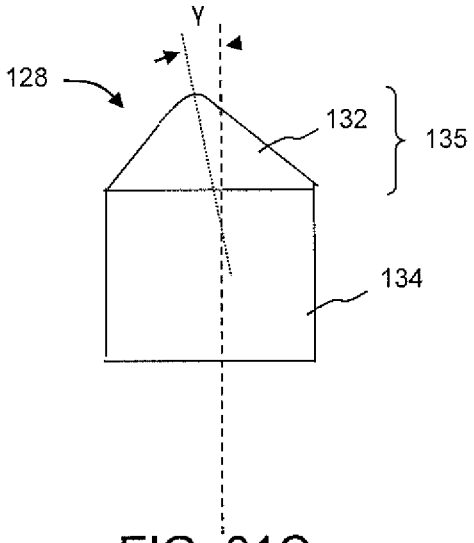

Referring now to FIGS. 31A-C, variations of conical cutting elements that may be in any of the embodiments disclosed herein are shown. The conical cutting elements 128 (variations of which are shown in FIGS. 31A-31C) provided on a drill bit or reamer possess a diamond layer 132 on a substrate 134 (such as a cemented tungsten carbide substrate), where the diamond layer 132 forms a conical diamond working surface. Specifically, the conical geometry may comprise a side wall that tangentially joins the curvature of the apex. Conical cutting elements 128 may be formed in a process similar to that used in forming diamond enhanced inserts (used in roller cone bits) or may brazing of components together. The interface (not shown separately) between diamond layer 132 and substrate 134 may be non-planar or non-uniform, for example, to aid in reducing incidents of delamination of the diamond layer 132 from substrate 134 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a critical zone that encompasses the primary contact zone between the diamond enhanced element and the formation. Additional shapes and interfaces that may be used for the diamond enhanced elements of the present disclosure include those described in U.S. Patent Publication No. 2008/0035380, which is herein incorporated by reference in its entirety. Further, the diamond layer 132 may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt).

As mentioned above, the apex of the conical cutting element may have curvature, including a radius of curvature. In this embodiment, the radius of curvature may range from about 0.050 to 0.125. In some embodiments, the curvature may comprise a variable radius of curvature, a portion of a parabola, a portion of a hyperbola, a portion of a catenary, or a parametric spline. Further, referring to FIGS. 31A-B, the cone angle β of the conical end may vary, and be selected based on the particular formation to be drilled. In a particular embodiment, the cone angle f3 may range from about 75 to 90 degrees.

Figure 33:
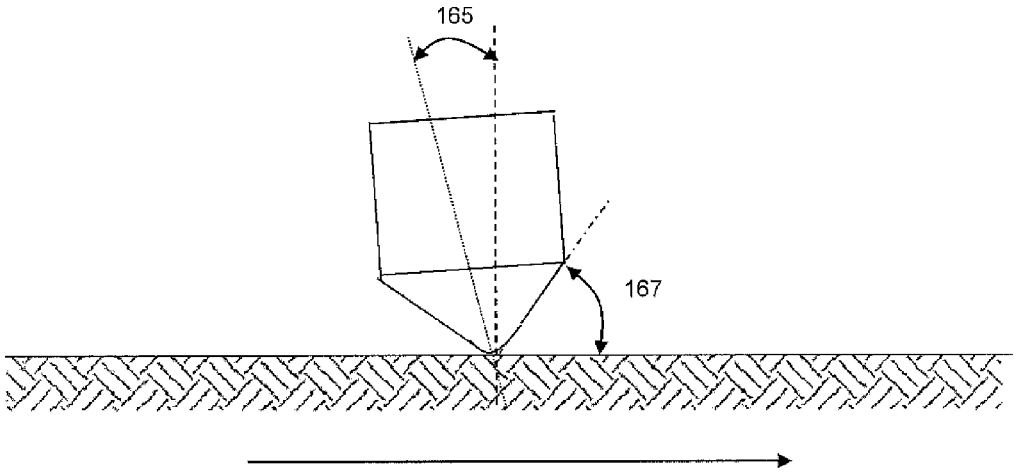
FIG. 33 shows an embodiment of a conical cutting element according to the present disclosure.
Figure 34:
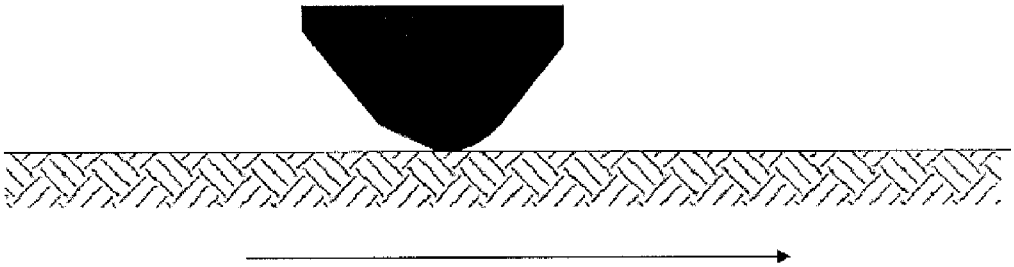
FIG. 34 shows an embodiment of a conical cutting element according to the present disclosure.

Referring now to FIG. 31C, an asymmetrical or oblique conical cutting element is shown. As shown in FIG. 31C, the cutting conical cutting end portion 135 of the conical cutting element 128 has an axis that is not coaxial with the axis of the substrate 134. In a particular embodiment, at least one asymmetrical conical cutting element may be used on any of the described drill bits or reamers. Selection of an asymmetrical conical cutting element may be selected to better align a normal or reactive force on the cutting element from the formation with the cutting tip axis or to alter the aggressiveness of the conical cutting element with respect to the formation. In a particular embodiment, the angle γ formed between the cutting end or cone axis and the axis of the substrate may range from 37.5 to 45, with angle on trailing side being greater, by 5-20 degrees more than leading angle. Referring to FIG. 33, the back rake 165 of an assymetrical (i.e., oblique) conical cutting element is based on the axis of the conical cutting end, which does not pass through the center of the base of the conical cutting end. The strike angle 167, as described above, is based on the angle between the leading portion of the side wall of the conical cutting element and the formation. As shown in FIG. 33, the cutting end axis through the apex is directed away from the direction of the rotation of the bit.

Figure 32A:
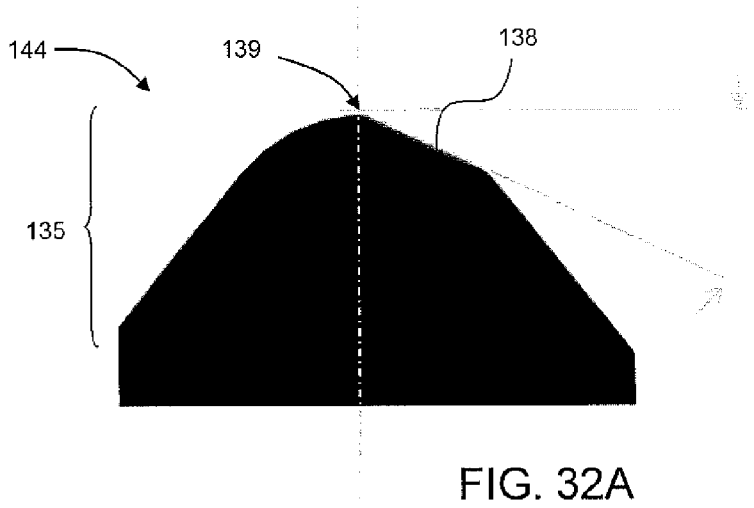
FIG. 32A-C shows various conical cutting elements according to the present disclosure.
Figure 32B:
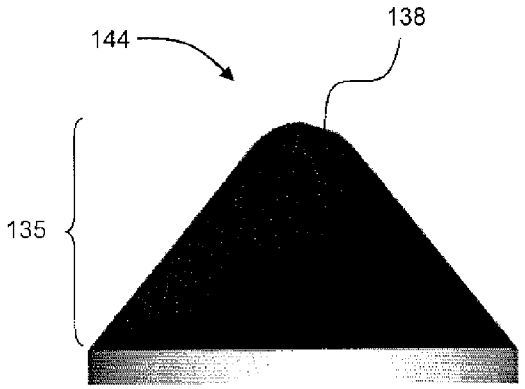
Figure 32C:
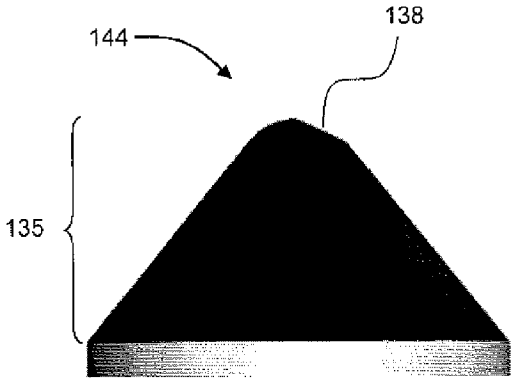

Referring to FIG. 32A-C, a portion of the conical cutting element 144, adjacent the apex 139 of the cutting end 135, may be beveled or ground off of the cutting element to form a beveled surface 138 thereon. For example, the slant cut angle of the bevel may be measured from the angle between the beveled surface and a plane normal to the apex of the conical cutting element. Depending on the desired aggressiveness, the slant cut angle may range from 15 to 30 degrees. As shown in FIGS. 32B and 32C, slant cut angles of 17 degrees and 25 degrees are shown. Further, the length of the bevel may depend, for example, on the slant cut angle, as well as the apex angle.

Figure 35:
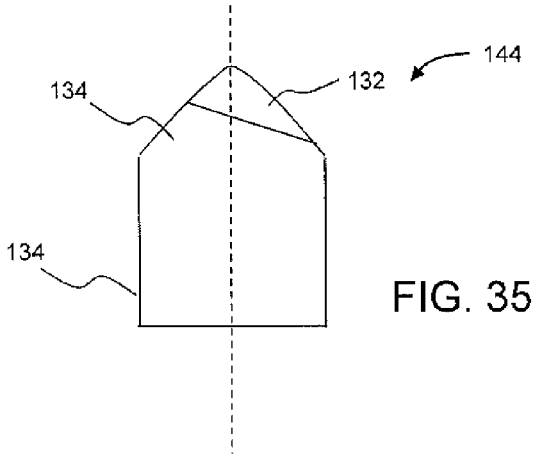
FIG. 35 shows an embodiment of a conical cutting element according to the present disclosure.

In addition to or as an alternative to a non-planar interface between the diamond layer 132 and the carbide substrate 134 in the conical cutting elements 144, a particular embodiment of the conical cutting elements may include an interface that is not normal to the substrate body axis, as shown in FIG. 35, to result in an asymmetrical diamond layer. Specifically, in such an embodiment, the volume of diamond on one half of the conical cutting element is greater than that of the other half of the conical cutting element. The selection of the angle of the interface with respect to the base may be selected, for example, based on the particular back rake, strike angle, apex angle, axis for the conical cutting end, and to minimize the amount of shear forces on the diamond-carbide interface and instead put the interface into greater compression stress than shear stress.

Some embodiments of the present disclosure may involve the mixed use of cutters and conical cutting elements, where cutters are spaced further apart from one another, and conical cutting elements are placed at positions intermediate between two radially adjacent cutters. The spacing between cutters 142 in embodiments (including those described above) may be considered as the spacing between two adjacent cutters 142 on the same blade, or two radially adjacent cutters 142 when all of the cutting elements are rotated into a single plane view.

Figure 36:
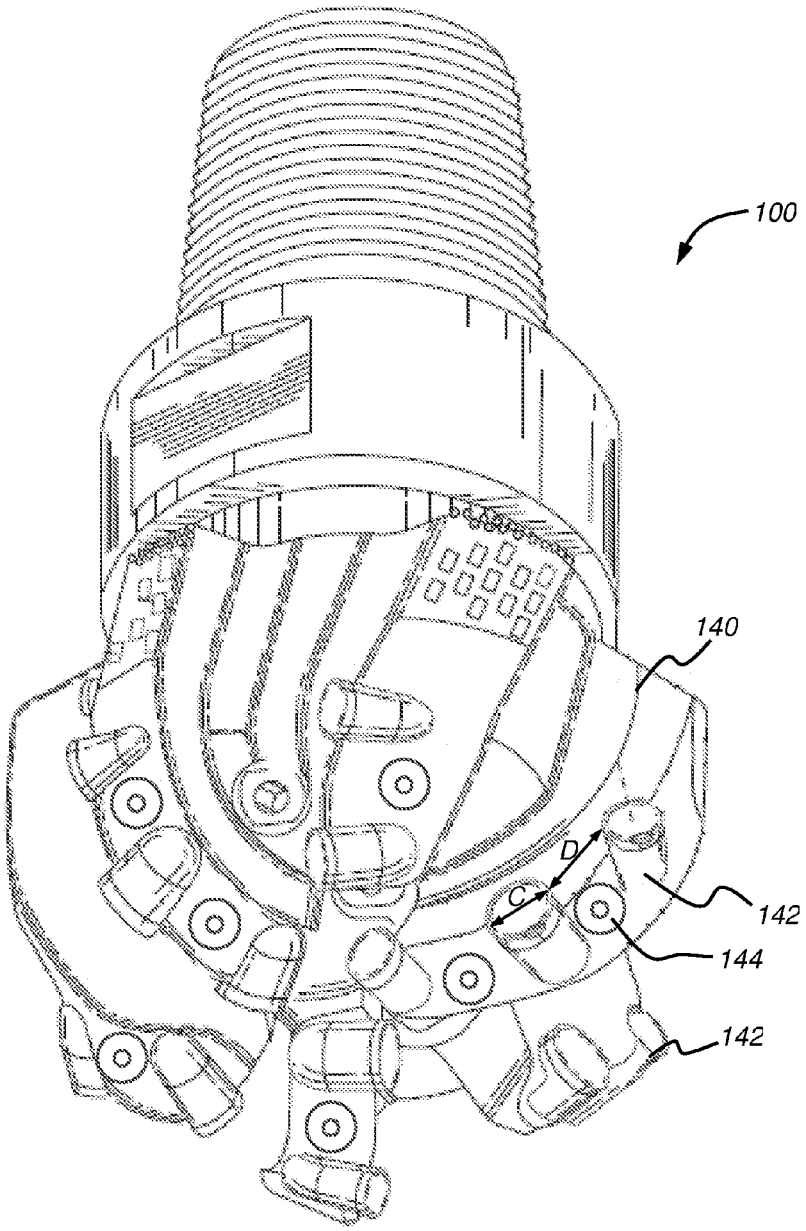
FIG. 36 shows a drill bit according to one embodiment of the present disclosure.

For example, referring to FIG. 36, a drill bit 100 may include a plurality of blades 140 having a plurality of cutters 142 and a plurality of conical cutting elements 144 thereon. As shown, cutters 142 and conical cutting elements 144 are provided in an alternating pattern on each blade 140. With respect to two cutters 142 adjacent one another (with a conical cutting element 144 therebetween at a trailing position) on the same blade, the two adjacent cutters may be spaced a distance D apart from one another, as illustrated in FIG. 36. In one embodiment, D may be equal to or greater than one-quarter the value of cutter diameter C, i.e., $\frac{1}{4}C \leq D$. In other embodiments, the lower limit of D may be any of 0.1C, 0.2C, 0.25C, 0.33C, 0.5C, 0.67C, 0.75C, C, or 1.5C, and the upper limit of D may be any of 0.5C, 0.67C, 0.75C, C, 1.25C, 1.5C, 1.75C, or 2C, where any lower limit may be in combination with any upper limit. Conical cutting elements 144 may be placed on a blade 140 at a radial intermediate position between two cutters (on the same blade or on two or more different blades in a leading or trailing position with respect to the cutters) to protect the blade surface and/or to aid in gouging of the formation.

Figure 37:
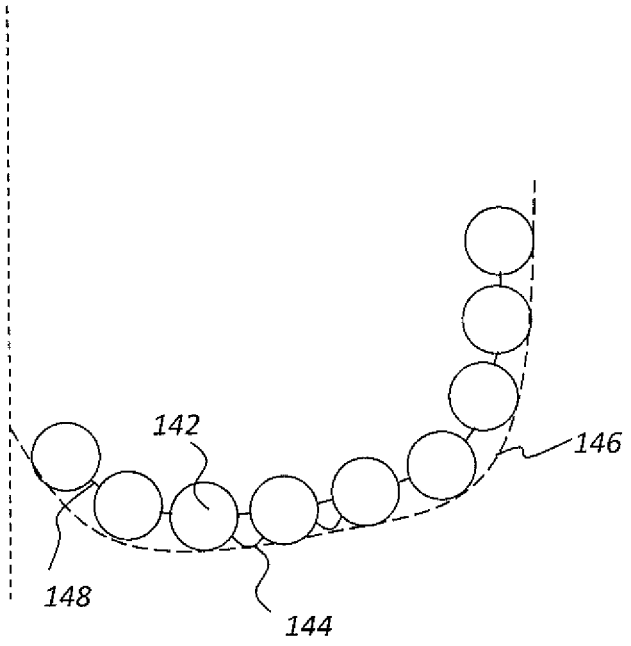
FIG. 37 shows a cutting profile according to one embodiment of the present disclosure.

The selection of the particular spacing between adjacent cutters 142 may be based on the number of blades, for example, and/or the desired extent of overlap between radially adjacent cutters when all cutters are rotated into a rotated profile view. For example, in some embodiments, it may be desirable to have full bottom hole coverage (no gaps in the cutting profile formed from the cutters 142) between all of the cutters 142 on the bit 100, whereas in other embodiments, it may be desirable to have a gap 148 between at least some cutters 142 instead at least partially filled by conical cutting elements 144, as illustrated in FIG. 37. In some embodiments, the width between radially adjacent cutters 142 (when rotated into a single plane) may range from 0.1 inches up to the diameter of the cutter (i.e. C). In other embodiments, the lower limit of the width between cutters 142 (when rotated into a single plane) may be any of 0.1C, 0.2C, 0.4C, 0.5C, 0.6C, or 0.8C, and the upper limit of the width between cutters 142 (when rotated into a single plane) may be any of 0.4C, 0.5C, 0.6C, 0.8C, or C, where any lower limit may be in combination with any upper limit.

Figure 38:
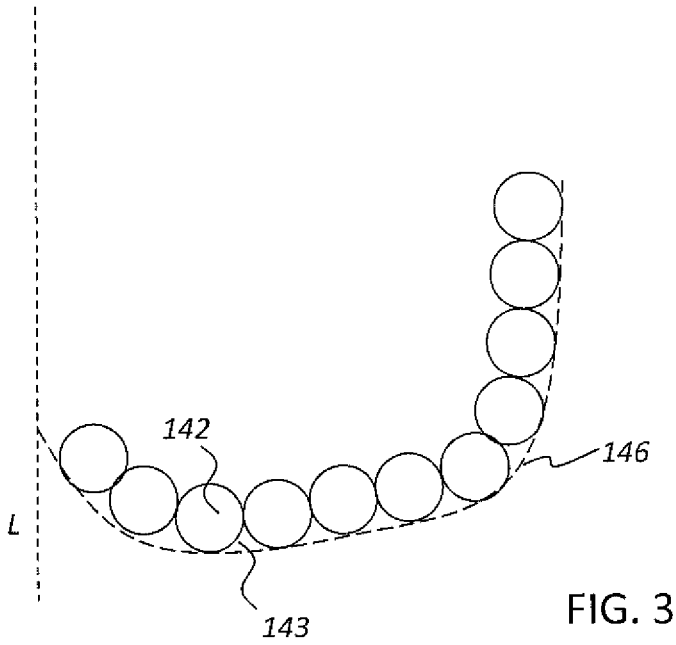
FIG. 38 shows a cutting profile according to one embodiment of the present disclosure.
Figure 39:
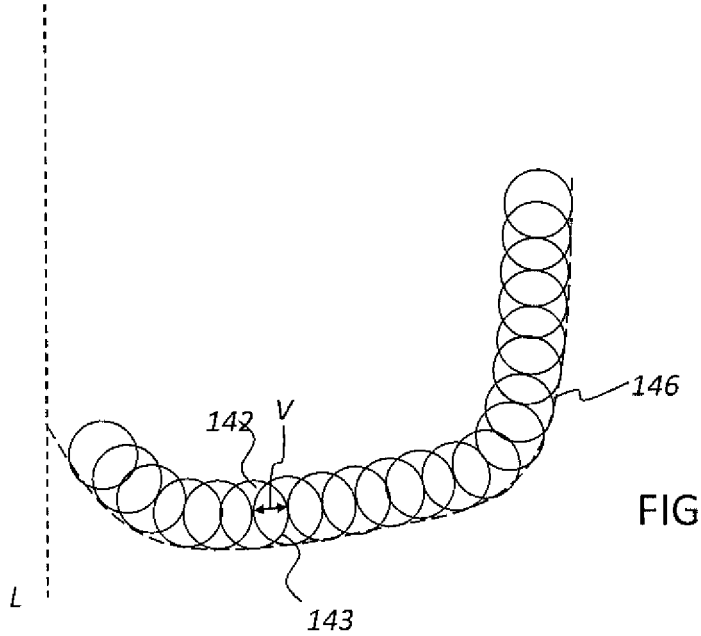
FIG. 39 shows a cutting profile according to one embodiment of the present disclosure.

In other embodiments, the cutting edges 143 of radially adjacent (in a rotated view) cutters 142 may be at least tangent to one another, as illustrated in FIG. 38 which shows another embodiment of cutting profile 146 of cutters 142 when rotated into a single plane view extending outward from a longitudinal axis L of bit (not shown). While not shown, conical cutting elements may be included between any two radially adjacent cutters 142 (in a rotated view), as discussed above. As illustrated in FIG. 39, showing another embodiment of cutting profile 146 of cutters 142 when rotated into a single plane view extending outward from a longitudinal axis L of bit (not shown), the cutting edges 143 of radially adjacent (in a rotated view) cutters 142 may overlap by an extent V. While not shown, conical cutting elements may be included between any two radially adjacent cutters 142 (in a rotated view), as discussed above. Overlap V may be defined as the distance along the cutting face of cutters 142 of overlap that is substantially parallel to the corresponding portion of the cutting profile 146. In one embodiment, the upper limit of overlap V between two radially adjacent (in a rotated view) cutters 142 may be equal to the radius of the cutter (or one-half the cutter diameter C), i.e., $V \leq C/2$. In other embodiments, the upper limit of overlap V may be based on radius (C/2) and the number of blades present on the bit, specifically the radius divided the number of blades, i.e., C/2B, where B is the number of blades. Thus, for a two-bladed bit, the upper limit of overlap V may be C/4, and for a four-bladed bit, the upper limit of overlap V may be C/8. Thus, V may generally range from $0<V \leq C/2$, and in specific embodiments, the lower limit of V may be any of C/10B, C/8B, C/6B, C/4B, C/2B, or 0.1C, 0.2C, 0.3C, or 0.4C (for any number of blades), and the upper limit of V may be any of, C/8B, C/6B, C/4B, C/2B, 0.2C, 0.3C, 0.4C, or 0.5C, where any lower limit may be used with any upper limit.

In an example embodiment, cutting faces of cutters may have a greater extension height than the tip of conical cutting elements (i.e., "on-profile" primary cutting elements engage a greater depth of the formation than the backup cutting elements; and the backup cutting elements are "off-profile"). In other embodiments, the conical cutting elements may have a greater extension height than conventional cutters. As used herein, the term "off-profile" may be used to refer to a structure extending from the cutter-supporting surface (e.g., the cutting element, depth-of-cut limiter, etc.) that has an extension height less than the extension height of one or more other cutting elements that define the outermost cutting profile of a given blade. As used herein, the term "extension height" is used to describe the distance a cutting face extends from the cutter-supporting surface of the blade to which it is attached. In some embodiments, a back-up cutting element may be at the same exposure as the primary cutting element, but in other embodiments, the primary cutter may have a greater exposure or extension height above the backup cutter. Such extension heights may range, for example, from 0.005 inches up to C/2 (the radius of a cutter). In other embodiments, the lower limit of the extension height may be any of 0.1C, 0.2C, 0.3C, or 0.4C and the upper limit of the extension height may be any of 0.2C, 0.3C, 0.4C, or 0.5C, where any lower limit may be used with any upper limit. Further extension heights may be used in any of the above embodiments involving the use of both conical cutting elements and cutters.

It is also within the scope of the present disclosure that any of the above embodiments may use non-conical but otherwise non-planar, gouging cutting elements in place of conical cutting elements, that is cutting elements having an apex that may gouge the formation, such as chisel-shaped, dome-shaped, frusta-conical-shaped, or faceted cutting elements, etc.

Figure 40:
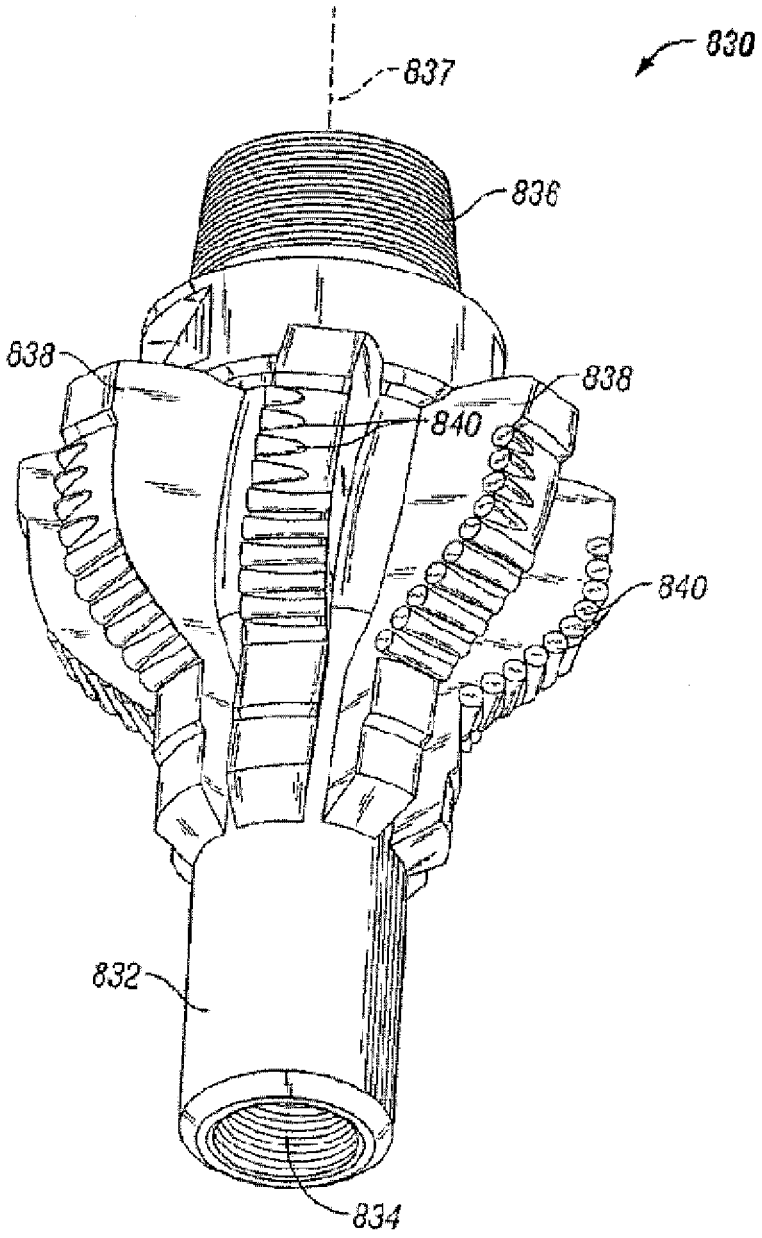
FIG. 40 shows a tool that may use the cutting elements of the present disclosure.

As described throughout the present disclosure, the cutting elements and cutting structure combinations may be used on either a fixed cutter drill bit or hole opener. FIG. 40 shows a general configuration of a hole opener 830 that includes one or more cutting elements of the present disclosure. The hole opener 830 comprises a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The tool body 832 may be formed from steel or from other materials known in the art. For example, the tool body 832 may also be formed from a matrix material infiltrated with a binder alloy.

The blades 838 shown in FIG. 40 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any prior art downhole cutting tool may be used. While FIG. 36 does not detail the location of the conical cutting elements, their placement on the tool may be according to all the variations described above.

Moreover, in addition to downhole tool applications such as a hole opener, reamer, stabilizer, etc., a drill bit using cutting elements according to various embodiments of the invention such as disclosed herein may have improved drilling performance at high rotational speeds as compared with prior art drill bits. Such high rotational speeds are typical when a drill bit is turned by a turbine, hydraulic motor, or used in high rotary speed applications.

Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm. Selection of cutting element sizes may be based, for example, on the type of formation to be drilled. For example, in softer formations, it may be desirable to use a larger cutting element, whereas in a harder formation, it may be desirable to use a smaller cutting element.

Further, it is also within the scope of the present disclosure that the cutters 142 may be rotatable cutting elements, such as those disclosed in U.S. Pat. No. 7,703,559, U.S. Patent Publication No. 2010/0219001, and U.S. patent application Ser. Nos. 13/152,626, 61/479,151, and 61/479,183, all of which are assigned to the present assignee and herein incorporated by reference in their entirety.

Embodiments of the present disclosure may include one or more of the following advantages. Embodiments of the present disclosure may provide for fixed cutter drill bits or other fixed cutter cutting tools capable of drilling effectively at economical ROPs and in formations having a hardness greater than in which conventional PDC bits can be employed. More specifically, the present embodiments may drill in soft, medium, medium hard, and even in some hard formations while maintaining an aggressive cutting element profile so as to maintain acceptable ROPs for acceptable lengths of time and thereby lower the drilling costs presently experienced in the industry. The combination of the shear cutters with the conical cutting elements can drill by creating troughs (with the conical cutting elements) to weaken the rock and then excavated by subsequent action by the shear cutter. Additionally, other embodiments may also provide for enhanced durability by transition of the cutting mechanism to abrading (by inclusion of diamond impregnation). Further, the various geometries and placement of the conical cutting elements may provide for optimizes use of the conical cutting elements during use, specifically, to reduce or minimize harmful loads and stresses on the cutting elements during drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole cutting tool, comprising:
a tool body;
a plurality of blades extending azimuthally from the tool body; and
a plurality of cutting elements disposed on the plurality of blades, the plurality of cutting elements comprising:
at least two conical cutting elements comprising a substrate and a diamond layer having a conical cutting end,
wherein at least one of the at least two conical cutting elements has a positive back rake angle, and at least one of the at least two conical cutting elements has a negative back rake angle, and
wherein a plurality of conical cutting elements in a cone region of the downhole cutting tool having a positive back rake angle and a plurality of conical cutting elements in a shoulder region of the downhole cutting tool have a negative back rake angle.

2. The downhole cutting tool of claim 1, wherein the at least one conical cutting elements having a positive back rake angle, and the at least one conical cutting elements having a negative back rake angle are disposed on the downhole cutting tool at the same radial position from a bit centerline.

3. The downhole cutting tool of claim 1, wherein the plurality of cutting elements further comprises at least one cutter having a substrate and a diamond table with a substantially planar cutting face, wherein in a rotated view of the plurality of cutting elements into a single plane, the at least one cutter is located a radial position from the downhole cutting tool axis that is intermediate the radial positions of the at least one conical cutting element having a positive back rake angle and the at least one conical cutting element having a negative back rake angle.

4. The downhole cutting tool of claim 1, wherein a plurality of conical cutting elements in a nose region of the downhole cutting tool have a substantially neutral back rake angle.

5. The downhole cutting tool of claim 1, wherein the plurality of cutting elements further comprises at least one cutter having a substrate and a diamond table with a substantially planar cutting face, wherein the at least one cutter is disposed at the same radial distance from a bit centerline as at least one of the conical cutting elements.

6. The downhole cutting tool of claim 1, wherein the at least two conical cutting elements are on two separate blades.

7. The downhole cutting tool of claim 1, wherein the at least two conical cutting elements are on the same blade.

8. The downhole cutting tool of claim 1, wherein the at least two conical cutting elements are disposed in a nose region and shoulder region of a cutting profile.

9. The downhole cutting tool of claim 1, further comprising a center coring conical cutting element disposed in a region between at least two blades.

10. The downhole cutting tool of claim 1, wherein the downhole cutting tool is a drill bit comprising:
a bit body having a bit axis and a bit face; and
a plurality of blades extending radially along the bit face.

11. The downhole cutting tool of claim 1, wherein the at least two conical cutting elements have a back rake selected from about −10 to 10.

12. A downhole cutting tool, comprising:
a tool body;
a plurality of blades extending azimuthally from the tool body; and
a plurality of cutting elements disposed on the plurality of blades, the plurality of cutting elements comprising:
at least two conical cutting elements comprising a substrate and a diamond layer having a conical cutting end,
wherein at least one of the at least two conical cutting elements has a positive side rake angle, and at least one of the at two least conical cutting elements has a negative side rake angle, wherein the at least two conical cutting elements are primary cutting elements, and wherein the at least two conical cutting elements are disposed in at least one of a nose region or a shoulder region of a cutting profile.

13. The downhole cutting tool of claim 12, wherein the at least one conical cutting elements having a positive side rake angle, and the at least one conical cutting elements having a negative side rake angle are disposed on the downhole cutting tool at the same radial position from a bit centerline.

14. The downhole cutting tool of claim 12, wherein the plurality of cutting elements further comprises at least one cutter having a substrate and a diamond table with a substantially planar cutting face, wherein in a rotated view of the plurality of cutting elements into a single plane, the at least one cutter is located a radial position from the downhole cutting tool axis that is intermediate the radial positions of the at least one conical cutting element having a positive side rake angle and the at least one conical cutting element having a negative side rake angle.

15. The downhole cutting tool of claim 12, wherein the plurality of cutting elements further comprises at least one cutter having a substrate and a diamond table with a substantially planar cutting face, wherein the at least one cutter is disposed at the same radial distance from a bit centerline as at least one of the conical cutting elements.

16. The downhole cutting tool of claim 12, wherein the at least two conical cutting elements are on two separate blades.

17. The downhole cutting tool of claim 12, wherein the at least two conical cutting elements are on the same blade.

18. The downhole cutting tool of claim 12, further comprising a center coring conical cutting element disposed in a region between at least two blades.

19. The downhole cutting tool of claim 12, wherein the downhole cutting tool is a drill bit comprising:
a bit body having a bit axis and a bit face; and
a plurality of blades extending radially along the bit face.

20. A drill bit for drilling a borehole in earth formations, comprising:
a bit body having a bit axis and a bit face;

a plurality of blades extending radially along the bit face;

a plurality of cutting elements disposed on the plurality of blades; and a conical coring cutting element disposed in a region between at least two blades, wherein an apex of the conical coring cutting element is at a height H less than a cutting edge of the most radially interior cutting element, wherein H ranges up to 0.35 times a diameter of the bit.

21. The drill bit of claim 20, wherein H is up to 0.1 times the bit diameter.

22. The drill bit of claim 20, wherein a cone angle of the conical coring cutting element ranges from 60 to 120 degrees.

23. The drill bit of claim 20, wherein a ratio of H to a diameter of the conical coring cutting element ranges from 0.5 to 3.

24. A downhole cutting tool, comprising:

a tool body;

a plurality of blades extending azimuthally from the tool body; and a plurality of cutting elements disposed on the plurality of blades, the plurality of cutting elements comprising:

at least one conical cutting elements comprising a substrate and a diamond layer having a conical cutting end, wherein a cutting profile of the plurality of cutting elements in a rotated view comprises at least one non-smooth step therein.

25. The downhole tool of claim 24, wherein the at least one conical cutting element transitions between adjacent stages and creates a vertex in the cutting profile.

26. The downhole tool of claim 25, wherein the conical cutting element creates a convex portion of the non-smooth cutting profile.

27. The downhole tool of claim 24, wherein the cutting profile further comprises an arcuate region therein.

28. The downhole tool of claim 24, wherein the plurality of cutting elements further comprises a plurality of cutters having a substrate and a diamond table having substantially planar cutting face.

29. The downhole tool of claim 28, wherein at least two cutters create a concave portion of the non-smooth cutting profile.

30. The downhole tool of claim 24, further comprising a conical coring cutting element at or adjacent a bit centerline.

* * * * *